US008206266B2

(12) United States Patent
Hall

(10) Patent No.: US 8,206,266 B2
(45) Date of Patent: Jun. 26, 2012

(54) SENSOR, CONTROL AND VIRTUAL REALITY SYSTEM FOR A TRAMPOLINE

(76) Inventor: David Hall, Manti, UT (US)

( * ) Notice: Subject to any disclaimer, the term of this patent is extended or adjusted under 35 U.S.C. 154(b) by 0 days.

(21) Appl. No.: 12/797,941

(22) Filed: Jun. 10, 2010

(65) Prior Publication Data

US 2011/0034300 A1 Feb. 10, 2011

Related U.S. Application Data

(60) Provisional application No. 61/252,274, filed on Oct. 16, 2009, provisional application No. 61/231,385, filed on Aug. 5, 2009.

(51) Int. Cl.
*A63B 71/00* (2006.01)
*A63B 5/11* (2006.01)

(52) U.S. Cl. ..... 482/1; 482/8; 482/27; 482/901; 482/902

(58) Field of Classification Search ..... 482/1–9, 482/23, 26, 27, 900–902; 434/247, 257
See application file for complete search history.

(56) References Cited

U.S. PATENT DOCUMENTS

| | | | | |
|---|---|---|---|---|
| 5,921,899 | A * | 7/1999 | Rose | 482/112 |
| 7,297,089 | B2 * | 11/2007 | Chen | 482/27 |
| 7,338,410 | B2 * | 3/2008 | Dardik | 482/13 |
| 2002/0137598 | A1 * | 9/2002 | Publicover et al. | 482/27 |
| 2004/0077975 | A1 * | 4/2004 | Zimmerman | 600/595 |
| 2006/0135321 | A1 * | 6/2006 | Chen | 482/27 |
| 2009/0111670 | A1 * | 4/2009 | Williams | 482/146 |
| 2010/0190608 | A1 * | 7/2010 | Publicover et al. | 482/8 |

* cited by examiner

*Primary Examiner* — Glenn Richman
(74) *Attorney, Agent, or Firm* — Webb IP Law Group; Jason P. Webb; Danny Y. H. Cheng

(57) ABSTRACT

A trampoline exercise system that is designed to show an avatar of a user, which is jumping on a trampoline. The exercise system includes a computer module, a trampoline configured to provide a platform for a user to perform exercises thereon, and a sensor module designed to sense movements of a user performed on the trampoline. The sensor module provides information that is received by the computer module that controls the display of a users' avatar on a video monitor in response to the users' motion on the trampoline. Several types of sensor may be used to sense the movement of the user, including body mounted sensors, trampoline mounted sensors, and remote viewing sensors.

5 Claims, 20 Drawing Sheets

SEEN FROM ABOVE x DIRECTION z DIRECTION

SEEN FROM ABOVE x DIRECTION z DIRECTION

SEEN FROM BESIDE x DIRECTION z DIRECTION

SENSOR, CONTROL AND VIRTUAL REALITY SYSTEM FOR A TRAMPOLINE

CLAIM OF PRIORITY

The present invention claims priority to two provisional patent applications, Ser. Nos. 61/252,274 and 61/231,385, both filed by inventor David Hall, of Manti, Utah, filed on Oct. 16, 2009 and Aug. 5, 2009 respectively, and entitled: System and method of instructing specific cellercises, and Trampoline Mat and shoe sensor system, respectively.

BACKGROUND OF THE INVENTION

1. Field of the Invention

The present invention relates to exercise and/or gaming systems and methods, specifically there is a trampoline with a sensor system configured to allow a user to potentially perform exercises and/or control a video game.

2. Description of the Related Art

An ever increasing awareness of the benefits of physical fitness grows every day. A healthy lifestyle is commonly known to include a balanced diet and a routine of exercises. Many people accomplish this lifestyle through fitness clubs or gymnasiums that provide equipment and personal training. However, personal training to stimulate aerobic and musculature development is quite expensive, difficult to routinely maintain, and often is thought to be boring and not very fun.

One particular well known fun device and has been used in personal exercise is to jump on a trampoline. Referring to prior art FIG. 1, there is illustrated one embodiment of a conventional trampoline 22, which includes a trampoline frame 34, to support the basic structure thereof. There is mounted to the frame 34, a jumping bed 31, a plurality of coil springs 32, and a plurality of upright legs 36. The legs 36 are adapted to be disposed uprightly on a ground surface and vertically coupled to the frame 34 in a spaced relationship to each other. The frame 34 shape, circular in this embodiment, defines a bed mounting space 37 or opening. The jumping bed 31, is mounted in the space 37, and includes a mat member 39 with a peripheral spring attachment portion 41. There is a plurality of coupling members 42, like grommets, peripherally mounted to the attachment portion 41, and designed to releasably couple to one end of the coil springs 32 respectively. A second opposite end of each spring 32 is designed to be releasably coupled to a plurality of frame mounting members 43, like a hook, ring or eye design, which are peripherally mounted in a spaced apart manner to the inner circumference of the frame 34. Thus, the jumping bed is resiliently suspended off the ground and held in the mounting space 37 by the frame 34 and the springs 32 to allow users to jump thereon without hitting the ground.

There are many other devices that can assist a user in exercise. Some go so far as to sense, measure and record bodily movements. Some of these prior art systems are presented herein, and are accordingly incorporated by reference, and are to be included into this application for all of the supportive teachings that one skilled in the art would need to practice the presently claimed and taught invention. Wherein, the incorporated related art is as follows:

There is taught, in U.S. Pat. No. 4,121,488, issued Oct. 24, 1978, a step-on type tone scale play device. In particular a step-on type tone scale play device that has a flexible mat within which is arranged a plurality of flexible switch elements in accordance with a tone scale and is adapted to produce corresponding music sounds when marks configured on the surface of a mat to indicate the position of each switch element are stepped on.

There is taught in U.S. Pat. No. 4,720,789, issued Jan. 19, 1988, a video exercise or game floor controller with position indicating foot pads. It incorporates the an exercise system utilizing a video display that is enhanced by a floor controller utilizing weight sensitive pads that allows an operator to input information into the system by locating his feet in specific portions of the floor controller.

In U.S. Pat. No. 5,144,847, issued Sep. 8, 1992, there is taught a pressure or force measuring device wherein a force or pressure sensor has a measuring body exposed to the measuring force and a reference body, said bodies both being supported at the housing via force measuring elements. In an evaluating circuit the signals of the force measuring elements, the second time derivatives of said signals and possibly also their first time derivatives are linked in such a manner that a signal representing the measuring force is obtained which is largely independent of the dynamic inherent behavior of the pressure sensor on shocks and vibrations of the housing and on rapid changes of the measuring force.

In U.S. Pat. No. 5,589,654, issued Dec. 31, 1996, there is taught an electronic dance floor system that consists of a dance floor having at least two dancing sections with each section further having at least four composite pad assemblies. Each of the assemblies is connected through a musical instrument digital interface (MIDI) converter to a MIDI equipped sound source. When a dancer, during his or her dance routine, steps on selected assemblies, an electrical switch module, embedded in each assembly triggers, the MIDI converter which, in turn, energizes the sound source. Thus, by stepping on selected assemblies a dancer can produce sounds that compliment the dancer's stepping routine. The system can also be designed to include a pair of tapping shoes. The shoes independently allow a sound(s) to be produced that enhances the sound(s) produced by the dance floor.

There is taught in U.S. Pat. No. 6,110,073, issued Aug. 29, 2000, a physical fitness device which is activated by pressure placed upon the stepping locations, permitting a user to interact with the device. A control panel can be used to select predefined programs or exercise modes from the microcomputer to be followed by the user. The programs test and improve the user's foot speed, agility, and reaction time. The microcomputer and display can preferably provide feedback to the user to indicate calories burned, time elapsed, and other fitness-related information, and also which stepping location has been stepped on or should be stepped on.

In U.S. Pat. No. 6,183,365, issued Feb. 6, 2001, there is taught a movement measuring device that determines the speed of the body's specific movement on the basis of the maximum value of the acceleration sensed by an acceleration sensing unit attached to the body, when the body has made a specific movement. For example, when the player wears the device on his arm and makes a punching motion, the punching speed is found from the maximum acceleration resulting from the punching action. Furthermore, a game device obtains data indicating the magnitude of a specific movement of the body, on the basis of the acceleration sensed by an acceleration sensing unit, and then decides the outcome of the game on the basis of the strength and weakness of the punch. This enables the user to easily play a fighting sport game involving the player's actual punching motions anywhere.

In U.S. Pat. No. 6,695,694, issued Feb. 24, 2004, there is taught a game machine, to evaluate a game operating performance from a new point of view, a control method for controlling a game machine allowing a player to enjoy stepping while listening to game music, comprises the steps of detecting whether or not the player puts their foot or feet on each of a plurality of step positions; judging, based on a detection result on the step position, according to which, of a plurality of pattern changes, a state of the player's feet relative to the plurality of step positions has changed to; calculating, based on the determined pattern change, an energy consumption amount due to a change of the state of the player's feet; calculating an accumulative energy consumption amount by accumulating an energy consumption amount calculated after a predetermined timing; and reporting the accumulative energy consumption amount calculated to the player.

In U.S. Pat. No. 6,758,753, issued Jul. 6, 2004, there is provided an input apparatus for game systems, which are simplified in construction. The input apparatus has a base having a plurality of panel-attaching sections, a plurality of foot panels, and tape switches not only arranged between a panel supporting surface formed on each of a plurality of panel-attaching sections and each of the foot panels but also outputting a predetermined detection signal responsively to changes in pushing load onto each foot panel. The tape switch has a sensing element and an elastic-material-made coating member covering the sensing element and functioning as a medium transmitting a load applied to each foot panel to the sensing element. The coating element supports the foot panel by contacting with each foot panel. Ribs are formed on the coating member, so that a load is intensively transmitted to a desired position on the sensing element.

In U.S. Pat. No. 6,902,513, issued Jun. 6, 2005, there is taught an apparatus directed to computerized fitness equipment that is designed to simulate, emulate, or implement actual race conditions with other users. An exemplar fitness equipment includes an operating component and sensors to monitor performance parameters of the at least one operating component (such as speed of movement). A display is also provided, along with logic to provide a visual display of a user's performance. In one embodiment, a communication interface is provided to communicate the first performance parameters to at least one remote, similarly-configured, fitness equipment. Performance parameters from the remote fitness equipment are also received through the communication interface. The fitness equipment includes logic to compare the first performance parameters with performance parameters received from remote fitness equipment and display the results in a comparative fashion to the user.

There is taught in U.S. Pat. No. 6,908,388, issued Jun. 21, 2005, a game system displaying a three-dimensional game space on a display including a housing held by a player, a tilt sensor, a viewpoint coordinates determination mechanism for determining viewpoint coordinates in accordance with an output value of the tilt sensor, and a game image generation processing mechanism for generating a game image based on the viewpoint coordinates determined by the viewpoint coordinate determination mechanism. The game system allows the player to feel as if the three-dimensional game space is tilted in accordance with a tilt of a game device, etc., with a minimal processing burden.

In U.S. Pat. No. 7,250,847, issued Jul. 31, 2007, there is taught an apparatus focused on a portable structure, generally in the form of a portable mat or other similar member, that can be moved or transported from place to place to be used in a temporary manner and placed on the ground for use in the process of facilitating the implementation of field exercise tests of individuals who are suspected of criminal or other activity such as driving under the influence of alcohol, such mat comprising in general a flat flexible mat-like member that can be placed flush against the ground for temporary use, such mat having an upper surface with demarcations thereon for guiding a person walking over the upper surface of the mat.

In U.S. Pat. No. 7,297,089, issued Nov. 20, 2007, there is taught a lighted trampoline having a frame, a bounce member and a bounce sensor, sensing bounces activates lights and provide sounds for entertainment and training purposes. A control box interprets a variety of inputs from the bounce sensors and outputs a variety of lights and sounds. A light is activated underneath the bounce member when the bounce sensor senses a bounce.

In U.S. Pat. No. 7,334,134, issued Feb. 26, 2008, there is taught an apparatus and method for an exercise apparatus incorporating sensor for translating body movement imparted to the exercise apparatus by the user that is measured and transmitted to a video game. The exercise apparatus has a platform with resistive arms forming a cradle for the user. The invention moves and senses motion in the transverse, anterior-posterior and longitudinal axis.

Although all of the above prior art teach of exercise, dancing and sensing systems, what is needed is a system, device and/or method that solves how to use a trampoline system with the measuring, sensing, recording, displaying, etc. abilities. The use of trampolines has historically been recognized as an excellent low or minimal impact exercise device. They can accommodate almost any level of physical exertion and can be effectively used by individuals of almost any age. However, state-of-the-art trampolines do not incorporate a way to monitor and record physical exercise routines or control games. Trampolines heretofore have not been able to provide the user with exercise response feedback data, i.e. heart rate, body fat, calories, level of exertion, type of routine, time of routine, and speed of routine. Further, with the current art of human monitoring device, the data recordings do not distinguish between jumping jacks, jump rope, gymnastics jumping exercise, running in place, etc. Current trampolines are not interactive with media outputs, including video, interactive games, music, light shows, personal video trainer, etc.

Accordingly, there exists a need for a trampoline system and/or device that solves one or more of the problems herein described or that may come to the attention of one skilled in the art after becoming familiar with this specification, drawings and a appended claims.

SUMMARY OF THE INVENTION

The present invention has been developed in response to the present state of the art, and in particular, in response to the problems and needs in the art that have not yet been fully solved by currently available systems and methods of human (natural) language translation. Accordingly, the present invention has been developed to provide a system and method of translating human language.

In one embodiment of the invention, there is a trampoline exercise system that is designed to show an avatar of a user, which is jumping on a trampoline. The exercise system includes a computer module, a trampoline configured to provide a platform for a user to perform exercises thereon, and a sensor module designed to sense movements of a user performed on the trampoline. The sensor module provides information that is received by the computer module that controls the display of a users' avatar on a video monitor in response to the users' motion on the trampoline. Several types of sensor may be used to sense the movement of the user, including body mounted sensors, trampoline mounted sensors, and remote viewing sensors.

Reference throughout this specification to features, characteristic, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
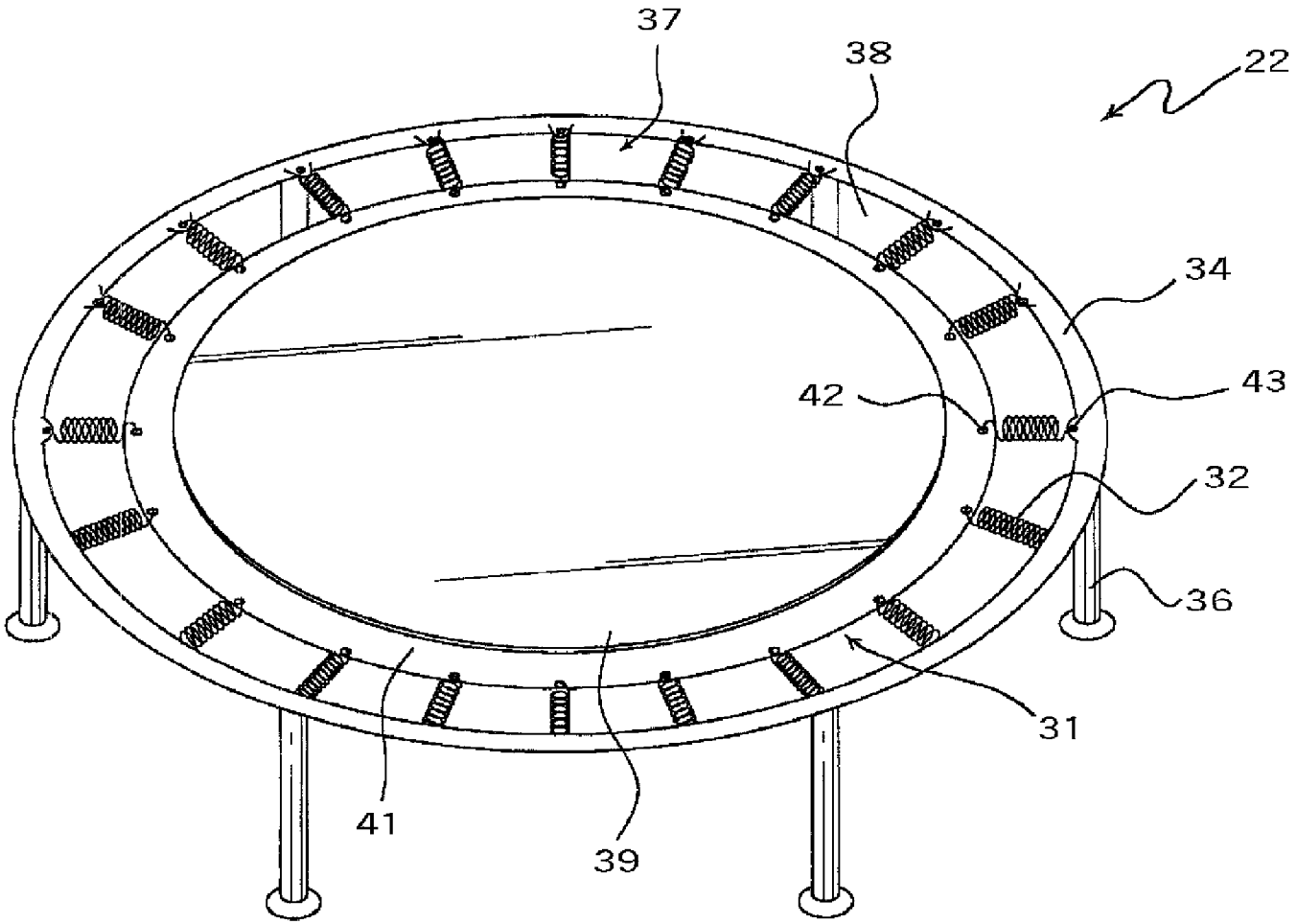
Figure 1 (Prior Art)
FIG. 1 is a perspective view of one embodiment of a prior art trampoline.

For the purposes of promoting an understanding of the principles of the invention, reference will now be made to the exemplary embodiments illustrated in the drawings, and specific language will be used to describe the same, for the purposes of promoting an understanding of the principles of the invention. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Legal Wording Definitions

Also, reference throughout this specification to "one embodiment," "an embodiment," or similar language means that a particular feature, structure or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Technical Wording Definitions

Many of the functional units described in this specification have been labeled as modules, in order to more particularly emphasize their implementation independence. Specifically, in one embodiment, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules, in another embodiment, may also be implemented in software for execution by various types of processors and memory chips. An identified module of programmable or executable code may, for instance, comprise one or more physical or logical blocks of computer instructions, which may, for instance, be organized as an object, procedure, logic loop, or function. Nevertheless, the executables of an identified module need not be physically located together on a similar board or CPU, but may comprise disparate instructions stored in different locations which, when joined logically together, comprise the module and achieve the stated purpose for the module.

Indeed, in one embodiment, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Additionally, modules may be a mix of hardware and software.

The various system components, in one embodiment, and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. As those skilled in the art will appreciate, any computers discussed herein may include an operating system (e.g., Windows Vista, NT, 95/98/2000, OS2; UNIX; Linux; Solaris; MacOS; and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" or "coupled" with other functional units and/or modules. These phrases are meant to refer to any manner and/or way in which functional units and/or modules, such as, but not limited to, computers, laptop computers, PDAs, modules, and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

The present invention describes an apparatus using a "panel" or series of panels, where in this wording is synonymous with words such as window, screen, interface, view panel, image, pixel display, or other words known in the art.

The illustrated embodiments refer to a "game/exercise" system. This wording is meant to be interchangeable, in that there is taught both a game and an exercise system. Both systems operate the same. It is the user that determines if there is just exercise mode or a game mode. Obviously, the game mode will provide exercise to the user during operation of the game system as described herein. Thus, the use of one designation, game or exercise system, is not intended to be a limitation to the claimed invention.

The term "sensor" is used throughout the present specification. It is intended that the term be used in a broad meaning. The term is intended to include both the plural and singular meaning. It is also meant to include any know type of sensor that is capable of performing the intended/described function/s. Non-limiting examples are provided in the "supporting technology" section below.

Supporting Technology Incorporated by Reference

The present invention is designed to implement any known components to provide the features of the illustrated embodiments. For example, some embodiments discuss using: computer hardware, software, wireless operations, sensors, video game modules, or display devices available. Nonetheless, the following exemplary patents are herein incorporated by reference for their respective non-limiting teachings on these referenced functions to operate the described invention, wherein: U.S. Pat. No. 4,754,327, issued Jun. 28, 1988, to Lippert, teaches of a single sensor providing three dimensional imaging for displaying images with effective three dimensional or stereo characteristics based on radial parallax, in monochrome or color. Additionally, U.S. Pat. No. 5,028,799, issued Jul. 2, 1991, to Chen et al., teaches of a method and apparatus for three dimensional object surface determination using coplanar data from multiple sensors. U.S. Pat. No. 5,181,181, issued to Glynn, on Jan. 19, 1993, teaches of a computer apparatus input device for three-dimensional information that senses six degrees of motion arising from movement. U.S. Pat. No. 6,504,385, issued Jan. 7, 2003, to Hartwell et al., teaches of a microelectromechanical system (MEMS) motion sensor for detecting movement in three dimensions. U.S. Pat. No. 6,373,235, issued Apr. 16, 2002, to Barker, teaches of an apparatus and method for determining the position and motion of an object and for precise measurement of phase related values. U.S. Pat. No. 6,767,282, issued Jul. 37, 2004, to Matsuyama et al., teaches of a motion controlled video entertainment system. U.S. Pat. No. 6,831,603, issued Dec. 14, 2004, to Menache, teaches of a motion tracking system and method within a three dimensional capture zone includes placing sensors around the capture zone. U.S. Pat. No. 6,921,332, issued Jul. 26, 2005, to Fukunaga et al., teaches of a match style 3D video game device by individually detecting movement in at least two axial directions. U.S. Pat. No. 6,712,692, issued Mar. 30, 2004, to Basson et al., teaches of using existing video games for physical training and rehabilitation. U.S. Pat. No. 6,164,973, issued Dec. 26, 2000, to Macri et al, teaches a processing system and method to provide users with user controllable images for use in interactive simulated physical movements. U.S. Pat. No. 6,204,813, issued Mar. 20, 2001, to Wadell et al., teaches of a local area multiple object tracking system, which includes spread spectrum radio transceivers with one transceiver positioned on each object. U.S. Pat. No. 6,554,318, issued Apr. 29, 2003, to Kohut et al., teaches of a sensor that senses tension on a belt. U.S. Pat. No. 7,272,979, issued Sep. 25, 2007, to Kaijala, teaches of a best tension sensor having an integrated connector. U.S. Pat. No. 6,209,915, issued Apr. 3, 2001, to Blakesley, teaches of a belt tension sensor for detecting the magnitude of tension in a belt.

DESCRIPTION OF THE ILLUSTRATED EMBODIMENTS

Figure 2:
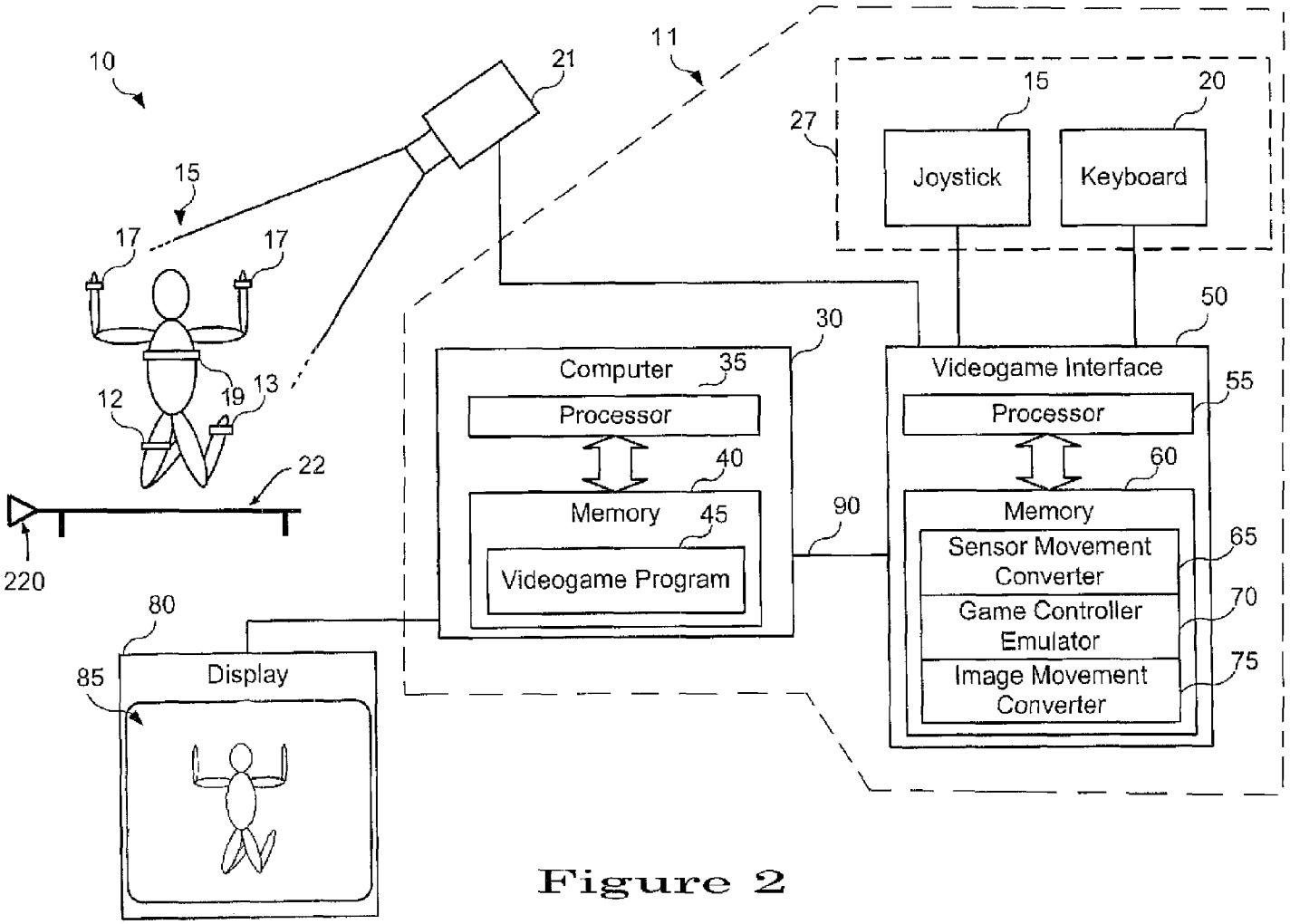
FIG. 2, is a block diagram of a trampoline with sensors and display system for game and exercise use, according to one embodiment of the invention.

Turning now to FIG. 2, there is an exemplary embodiment system 10 shown for using existing videogames for physical training and rehabilitation, in accordance with embodiments of the present invention. System 10 illustrates one embodiment of the invention, where a game/computer system/module 11 receives sensor information responsive to movement of a user 16 and displays such movement action of the user as a sprite or avatar 85 on a display module 80. In particular, the game/exercise system/module 11, may be designed to include a sub-computer system/module 30, a "videogame interface" 50, and controllers 15 and 20 (generally referred to collectively as controllers 27). Controllers 27 are exemplary game controllers/modules that are interfaced to a game computer/module 30. The game/sub-computer module 30 could be most any device, and could be in particular a Wii®, Nintendo®, Playstation®, Apple®, iPhone®, Gameboy®, PC, or any other known or to be developed system that is capable of providing gaming-like functionality. Computer module 30 may comprise, in this embodiment, a processor module 35 and a memory module 40, which comprises videogame program module 45. Videogame interface module 50 comprises, in this embodiment, a processor module 55 and a memory module 60. In memory 60, there is a sensor movement converter/module 65, a game controller emulator/module 70, and an image movement converter/module 75.

User 16 has a number of sensors on him, as illustrated in this embodiment. Sensors 17, 12, and 13 sense position or movement or both of parts of the body which they are attached thereto. Sensor 19 may sense the heart rate, for example or just movement of the overall body. These sensors can be analog or digital or a combination of these. For instance, gloves are commonly used to capture hand movements, and these gloves are usually wired directly to a computer system such as videogame interface module 50. Additional sensors and techniques for using them are plethora, and well know by one skilled in the art of sensors and measurement. These sensors can be connected to videogame interface 50 through wires and appropriate interfaces (not shown) or through wireless systems and appropriate wireless interfaces. Display module 80 is currently displaying the output 85 of a video images from the videogame program module 45.

It is noted that the videogame interface is provided to easily add sensor signals 12, 13, 17, 19, 220 to a standard video game that is found on the market. The videogame interface 50 generally operates in two modes. In one mode, commands from the game controllers 27 (e.g., joystick 15 and keyboard 20) pass unchanged through the videogame interface 50 to the standard video game program 45. It should be noted that the "commands" from joystick 15 and keyboard 20 can be signals and the word "commands" should be interpreted to encompass digital or analog signals. In another mode, the videogame interface 50 gathers information about movements of a person 16 and converts these movements, picked up by the sensors 12, 13, 17, 19, and 220 into the already known game controller commands (in this example, joystick commands, keyboard commands, or both). Additionally, although only joystick 15 and keyboard 20 are shown, those skilled in the art will realize that there are many different game controllers 27 that can be emulated, such as mice, track balls, game pads, and steering wheels. Joystick 15 and keyboard 20 are used as examples of possible game controllers 27 solely for the sake of simplicity.

Information about the movements is collected from sensors 17, 19, 12, 220 and 13 or from camera 21 or from all of these. The joystick 15 or keyboard 20 commands are sent over connection 90 to videogame program 45, which interprets the commands and acts on them. In the example of this embodiment, connection 90 is a device suitable for communicating both joystick and keyboard commands to computer system 30. For instance, the connection 90 could be a Universal Serial Bus (USB) cable or Firewire (also known by the Institute of Electronic and Electrical Engineers Standard 1394). Optionally, separate cables for each of the joystick 15 and keyboard 20 can be provided.

Based on movement information from the sensors or from video on camera 21, the videogame interface 50 will create appropriate commands suitable for controlling videogame program 45. The sensor movement converter 65 and image movement converter 75 are discussed in more detail below. Briefly, each converter 65, 75 takes an input and determines classes of movement from the input. The game controller emulator 70 maps the classes into game controller 27 commands (e.g., joystick 15 or keyboard 20 commands etc.). Optionally, each converter 65, 75 can create basic commands (such as "move right" or "move up") and the game controller emulator 70 converts the basic commands to actual game controller (e.g., joystick 15 or keyboard 20 etc.) commands.

In the example of this embodiment, the videogame program 45 is an exercise program that has an output 85 showing a person avatar. Although not shown in the figure, speech may be increased or decreased by appropriate movements of the user 16.

The two modes for videogame interface 50 discussed above are not necessarily exclusive. For instance, it is possible that the keyboard 20 may be used to activate and deactivate a menu associated with the game. Such a menu could, illustratively, be used to stop the game or advance it to the next level, while movements of user 16 are being interpreted by the videogame interface 50 and converted into game controller commands.

Illustrated Computer Embodiment

Figure 3:
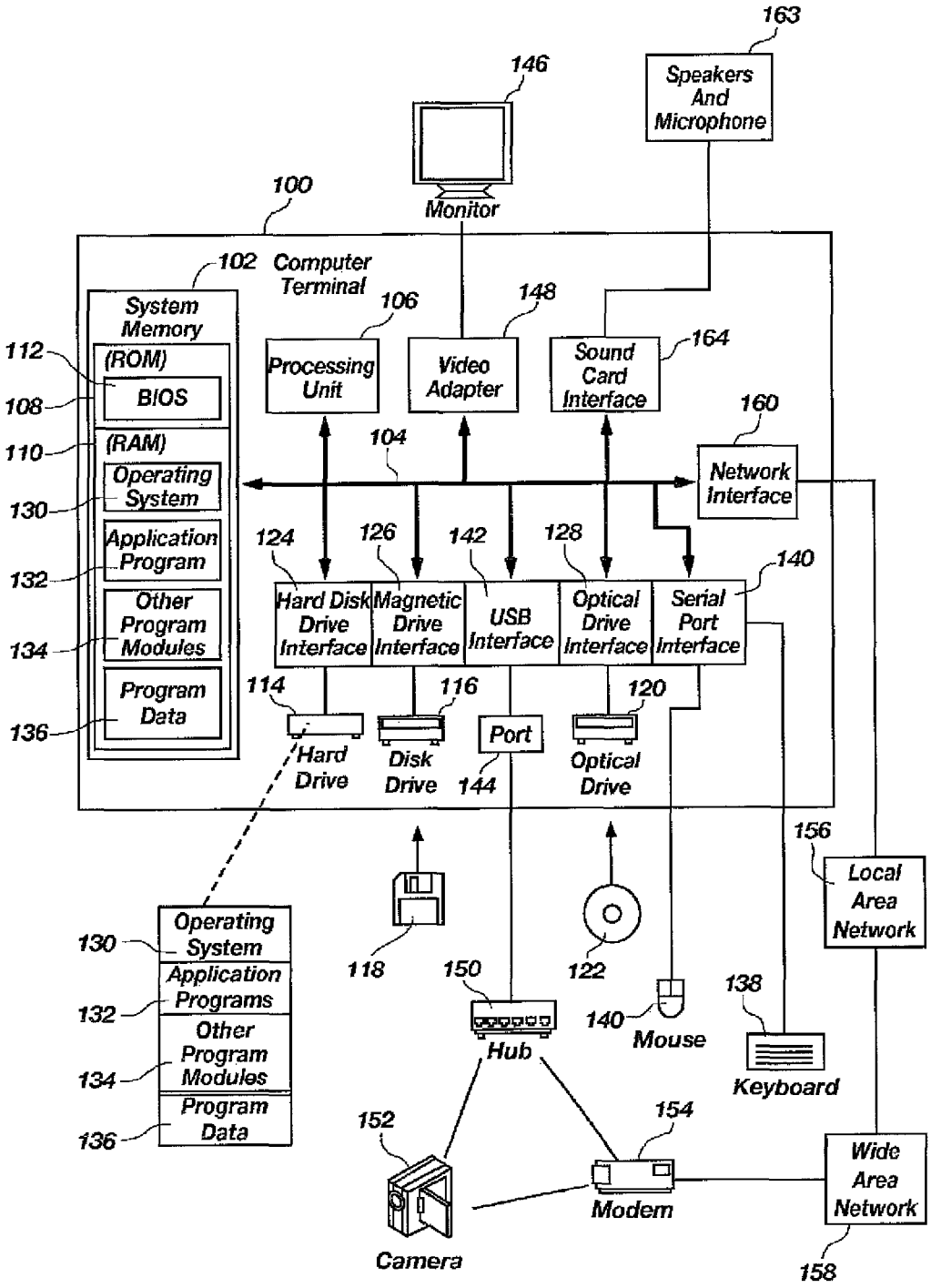
Figure 3 (Prior Art)
FIG. 3 is a block diagram of a computer system for use in the game and/or exercise system, according to one embodiment of the invention.
Figures 4, 5, 6:
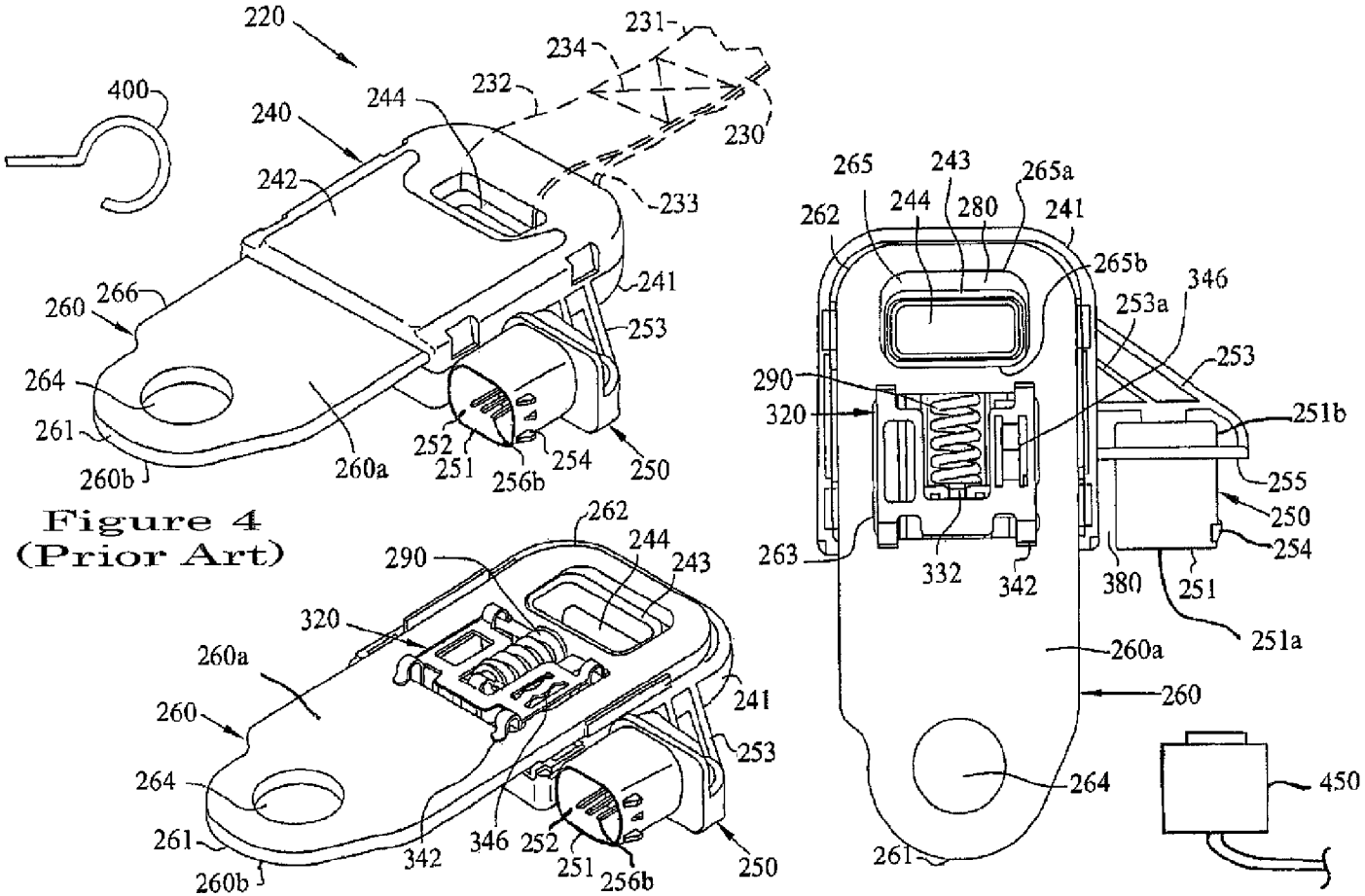
Figure 4 (Prior Art)
Figure 5 (Prior Art)
Figure 6 (Prior Art)
FIG. 4 illustrates a prior art sensor to be attached between at least one spring and frame of the trampoline illustrated in FIG. 1, according to one embodiment of the invention.
FIG. 5 illustrates the sensor of FIG. 4 with a top cover removed, according to one embodiment of the invention.
FIG. 6 illustrates a bottom view of the sensor of FIG. 4, according to one embodiment of the invention.
Figure 7:
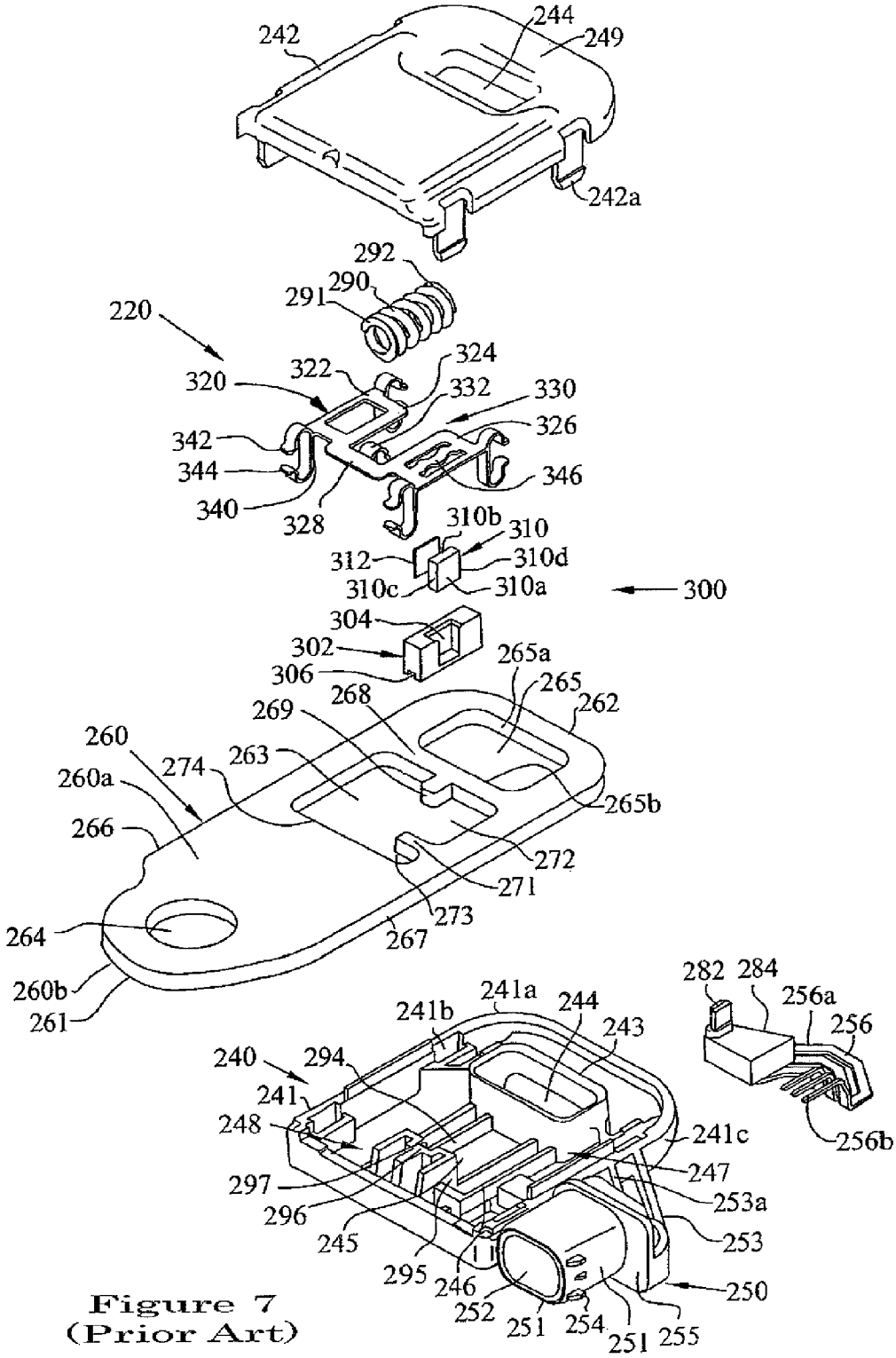
Figure 7 (Prior Art)
FIG. 7 is an exploded illustration of the sensor of FIG. 4, according to one embodiment of the invention.
Figure 8:
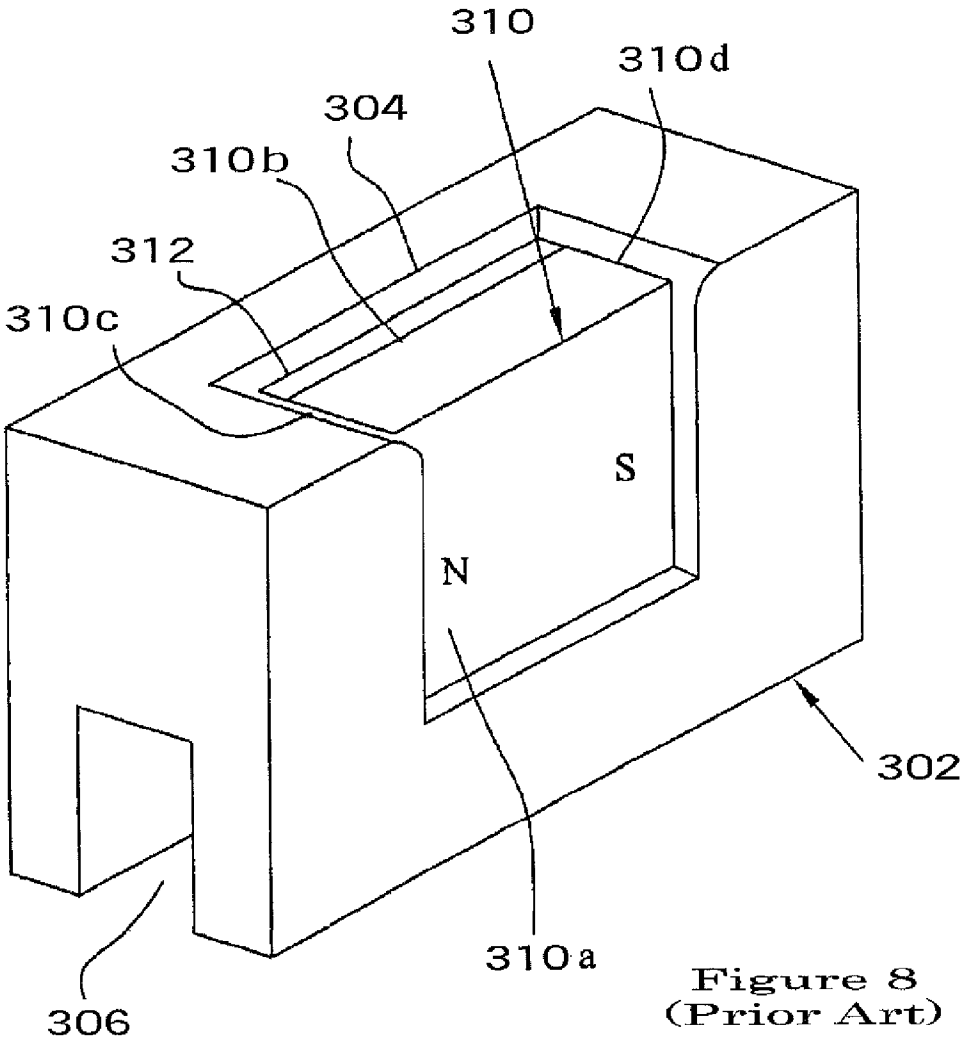
Figure 8 (Prior Art)
FIG. 8 is a perspective illustration of a portion of the sensor from FIG. 4, according to one embodiment of the invention.

Referring now to FIG. 3, there is shown an exemplary embodiment of a generic all purpose computer 100, which may be used for the computing devices used in this present disclosure for computer games using a standard computer in place of the specialized limited capacity computer designed exclusively for games 130, like the wii, Nintendo etc. It will be appreciated that the computing devices may have more or fewer features than shown as the individual circumstances require. Further, the computer 100 shown may have various forms, including a desktop PC, a laptop or a portable tablet form, or a hand held form. The features shown may be integrated or separable from the illustrated computer 100. For example, while a monitor 146 is shown as being separate, it may be integrated into the computer 100, such as the case of a laptop or tablet type computer.

The computer 100 may include a system memory 102, and a system bus 104 that interconnects various system components including the system memory 102 to 3 the processing unit 106. The system bus 104 may be any of several types of bus structures including a memory bus or memory controller, a peripheral bus, and a local bus using any of a variety of bus architectures as is known to those skilled in the relevant art. The system memory may include read only memory (ROM) 108 and random access memory (RAM) 110. A basic input/output system (BIOS) 112, containing the basic routines that help to transfer information between elements within the computer 100, such as during start-up, is stored in ROM 108. The computer 100 may further include a hard disk drive 114 for reading and writing information to a hard disk (not shown), a magnetic disk drive 116 for reading from or writing to a removable magnetic disk 118, and an optical disk drive 120 for reading from or writing to a removable optical disk 122 such as a CD ROM, DVD, or other optical media.

It will be appreciated that the hard disk drive 114, magnetic disk drive 116, and optical disk drive 120 may be connected to the system bus 104 by a hard disk drive interface 124, a magnetic disk drive interface 126, and an optical disk drive interface 128, respectively. The drives and their associated computer-readable media provide nonvolatile storage of computer readable instructions, data structures, program modules and other data for the computer 100. Although the exemplary environment described herein employs a hard disk, a removable magnetic disk 118, and a removable optical disk 122, it will be appreciated by those skilled in the relevant art that other types of computer readable media which can store data that is accessible by a computer, such as magnetic cassettes, flash memory cards, digital video disks, Bernoulli cartridges, random access memories, read only memories, and the like may also be used in the exemplary operating environment.

A number of program modules may be stored on the hard disk 114, magnetic disk 118, optical disk 122, ROM 108 or RAM 110, including an operating system 130, one or more applications programs 132, other program modules 134, and program data 136. A user may enter commands and information into the computer 100 through input devices such as a keyboard 138 and a pointing device 140, such as a mouse. Other input devices (not shown) may include a joystick, game pad, satellite dish, scanner, or the like. These and other input devices are often connected to the processing unit 106 through a serial port interface 140 that is coupled to the system bus 104. Increasingly, such devices are being connected by the next generation of interfaces, such as a universal serial bus (USB) interface 142 with a USB port 144, and to which other hubs and devices may be connected. Other interfaces (not shown) that may be used include parallel ports, game ports, and the IEEE 1394 specification.

A monitor 146 or other type of display device is also connected to the system bus 104 via an interface, such as a video adapter 148. In addition to the monitor 146, computers 100 typically include other peripheral output or input devices. For example, an ultra slim XGA touch panel may be used. A resistive finger touch screen may also be used.

A USB hub 150 is shown connected to the USB port 144. The hub 150 may in turn be connected to other devices such as a digital camera 152 and modem 154. Although not shown, it is well understood by those having the relevant skill in the art that a keyboard, scanner, printer, external drives (e.g., hard, disk and optical) and a pointing device may be connected to the USB port 144 or the hub 150. Thus, it should be understood that additional cameras and devices may be directly connected to the computer through the USB port 144. Thus, the system depicted is capable of communicating with a network and sending/receiving audio, video and data.

The computer 100 may operate in a networked environment using logical connections to one or more remote computers. The types of connections between networked devices include dial up modems, e.g., modem 154 may be directly used to connect to another modem, ISDN, xDSL, cable modems, wireless and include connections spanning users connected to the Internet. The remote computer may be another personal computer, a server, a router, a network PC, a peer device or other common network node, and typically includes many or all of the elements described above relative to the computer 100 shown. The logical connections include a local area network (LAN) 156 and a wide area network (WAN) 158. Such networking environments are commonplace in offices, enterprise-wide computer networks, intranets and the Internet.

When used in a LAN networking environment, the computer 100 is connected to the local network 156 through a network interface or adapter 160. The computer 100 may also connect to the LAN via through any wireless communication standard, such as the standard 802.11 wireless system. When used in a WAN networking environment, the computer 100 typically uses modem 154 or other means for establishing communications over the wide area network 158. It should be noted that modem 154 may be internal or external and is connected to the system bus 104 through USB port 144. A modem may optionally be connected to system bus 104 through the serial port interface 140. It will be appreciated that the network connections shown are exemplary and other means of establishing a communications link between the computers may be used, e.g., a from a LAN gateway to WAN.

The computer 100 may also receive audio input from a microphone and output audio sounds through speakers as illustratively shown by the box marked with the reference numeral 163 in FIG. 3. A sound card interface 164 processes the sounds to a sound card and the system bus 164. Further, the computer 100 may take many forms as is known to those having relevant skill in the art, including a desk top personal computer, a lap top computer, a hand held computer, and the like. Further, the computer compatibility of the computer 100 may include, without limitation, IBM PC/XT/AT, or compatibles, or Apple Macintosh. The operating system 130 compatibility may include, without limitation, MS-DOS, MS-Windows, Unix, or Macintosh.

Generally, the data processors of computer 100 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The disclosure described herein includes these and other various types of computer-readable storage media when such media contain instructions or programs for implementing the steps described herein in conjunction with a microprocessor or other data processor. The disclosure also includes the computer itself when programmed according to the methods and techniques described herein.

The computer 100 may have loaded into memory a web browser, which is an application program that provides a way to look at and interact with all the information on the World Wide Web. Netscape and Microsoft Internet Explorer are examples of two types of browsers that may be used. Firefox is another example.

A server may also take substantially the same form as the computer 100 shown in FIG. 3. The server, in its simplest form, is a computer that stores Web documents and makes them available to the rest of the world over the World Wide Web. The server may be dedicated, meaning its sole purpose is to be a server, or non-dedicated, meaning it can be used for basic computing in addition to acting as a server. In one embodiment, the main body of software used with the present disclosure resides on the web server. Software may also reside on other terminals as needed or desired.

The computer 100 may be directly connected to a power source, such as AC power, or comprise a battery for allowing portable operation. The computer 100 may also include other features not explicitly shown in FIG. 3, including expansion slots for adding additional hardware to the terminal 100 and I/O ports which may include RJ-11 modem, RJ-45 fast ethernet ports, USB ports, IEEE 1394 ports, headphone jack, microphone jack, and a VGA port. Additional features of the terminal also not explicitly shown may include short-cut buttons, a wheel key, a power switch and a wireless LAN On/Off switch.

Illustrated Spring Sensor Embodiment

The present invention has been described with one particular sensor 220 located on the trampoline. In one embodiment, this sensor is a tension sensor 220 coupled between a spring and the trampoline bed 31. Referring to FIGS. 4-8, one illustrative embodiment of a tension sensor assembly 220 is shown. Assembly 220 has a housing 240 and anchor plate 260. Housing 240 is fastened between a webbing of a trampoline 230 and a structural part of a trampoline or at least one spring that is usually positioned around the mat of the trampoline (not shown). The webbing 230 may have an end 231, an end 232, a belt loop 233 and stitching 234 that retains end 232. Housing 240 has a bottom portion 241, top portion 242, flange 243, hole 244, spring channel 245, bearing rail 246 and sensor mounting area 247. A cavity 248 is located within housing 240. The bottom portion 241 and top portion 242 connect together to form housing 240 and are held together by snap fitting tabs 242*a* in to slots 242*b*. Alternatively, ultrasonic welding along lip 241A can connect portions 241 and 242 together. Housing portion 242 has a recess or narrow portion 249 on an end of the housing where the webbing attaches.

An integral connector 250 extends from housing bottom portion 241. Connector 250 is integrally molded into housing portion 241 during injection molding of the housing. Integral connector 250 has a shroud 251 that has a recess 252. Shroud 251 has shroud ends 251A and 251B. Several latch tabs 254 are mounted on shroud 251. Plate 255 supports shroud 251. Shroud end 251A extends from one side of plate 255 and shroud end 251B extends from the other side of plate 255. A molded support or bracket 253 reinforces the attachment between integral connector 250 and housing portion 241. Molded support or bracket 253 extends between housing side 241C and a plate 255. Plate 255 connects between shroud 251 and side 241C. Bracket 253 has webbing 253A that adds additional mechanical strength to bracket 253. Shroud 251 is spaced from side 241C by an air gap 180.

Three electrically conductive metal terminals 256 have ends 256A and 256B. Terminals 256 are integrally molded into housing portion 241 during injection molding of the housing. Terminals 256 extend between sensor mounting area 247 in housing 240 and recess 252. Terminal ends 256A extend into sensor mounting area 247 and terminal ends 256B extend into recess 252 of shroud 251. Housing 241, bracket 253, plate 250 and shroud 251 can be molded from plastic. The plastic surrounds and support each terminal and insulates the terminals. Terminal end 256A is adapted to be connected to an external wire harness 250. The wire harness would fit over shroud 251 and be retained by latch tabs 254. Wire harness 250 would connect with a computer (not shown).

In an additional embodiment, terminals 256 could be press-fit into shroud 251, support 253 and housing 241. In this example, terminals 256 are retained by friction between the terminals and the surrounding structure primarily support 253.

The use of integral connector 250 has many advantages. Integral connector 250 eliminates the need for a separate wire harness and connector. Since integral connector 250 is rigidly held by bracket 253, a separate strain relief mechanism is not required. If a wire harness and connector was used, a separate strain relief mechanism would be required to prevent the wire harness from being pulled out of housing 240. Integral connector 250 eliminates the need for a separate printed circuit board because hall effect device 282 is mounted directly to terminals 256.

A metal anchor plate 260 is fitted within housing 240. Anchor plate 260 has a top surface 260A and bottom surface 260B. Anchor plate 260 includes ends 261 and 262, a cutout 263, apertures 264 and 265 and sides 266 and 267. Anchor plate 260 further has edges 265A and 265B that are next to aperture 265. Arm 268 extends between sides 266 and 267 and separates aperture 265 and cutout 263. A projection 269 extends from arm 268 into cutout 263. Projection 271 extends into cutout 263. Projection 271 and arm 268 define a sensor mounting opening 272. Notch 273 is defined between projection 271 and an edge 274 of cutout 263. Anchor plate 260 is mounted in cavity 248. Aperture 265 goes over and surrounds flange 243. A gap 280 is formed between flange 243 and aperture 265.

Webbing 230 is attached through hole 244 and aperture 265; this webbing would be coupled to the trampoline mat 39 or other portions of the surface that users jump upon. The end 232 of webbing 230 is routed through hole 244 and aperture 265, wrapped back onto itself forming loop 233 and sewn with stitching 234 to secure the webbing to assembly 220. The opposite end of the plate may be connected to at least one of the springs 400 of the trampoline by extending an end portion of the spring through hole 264.

A coil spring 290 is mounted in spring channel 245. Spring 290 has ends 291 and 292. Spring channel 245 is defined by walls 294, 295 and 296 in housing 240. Spring end 292 is mounted over projection 269. The other spring end 291 rests against wall 296. Spring 290 is adapted to bias anchor plate 260 from housing 240 such that gap 280 is open. A slot 297 is located in wall 296.

A magnetic field sensor or hall effect device 282 is mounted to terminal end 256A and extends upwardly into sensor mounting area 247. Additional electronic components (not shown), such as an integrated circuit can also be attached to terminal ends 256A to condition the signal from the hall effect device 282. Since, terminals 256 are insert molded, hall effect device 282 is retained in the proper position in sensor mounting area 247. Hall effect device 282 can be mounted to terminal ends 256A by soldering. Hall effect device 282 and ends 256*a* can be encapsulated with a sealant 284 such as silicone for protection.

A magnetic field generator or magnet assembly 300 includes a magnet carrier 302 and a magnet 310. Magnet carrier 302 has a cavity 304 and a slot or mortise 306. The magnet carrier is preferably formed from an insulative material such as a plastic. A magnet 310 has sides 310A and 310B and ends 310C and 310D. End 310C can be a north pole and end 310D can be a south pole. A steel pole piece 312 may be mounted on magnet side 310B. Pole piece 312 improves the shape of and guides the flux field generated by magnet 310. Pole piece 312 may be omitted if desired. Magnet 310 and pole piece 312 are mounted in and retained by cavity 304. Magnet 310 can be formed from molded ferrite or can be formed from samarium cobalt or neodymium iron boron. Magnet 310 has a changing polarity along the length of the magnet.

The magnet 310 could also be a tapered magnet or could be a magnet that has a variable field strength along its length. The magnet 310 may have a variable polarization or a variable magnetic domain alignment along its length. Magnet 310 may also comprise more than one magnet and may be several magnets.

Magnet assembly 300 is mounted in sensor opening 272 and rests on rail 246. Bearing rail 246 extends into mortise or slot 306 such that magnet carrier 302 is supported by bearing rail 246. Magnet carrier 302 slides on bearing rail 246 as the housing 240 moves relative to the anchor plate 260.

A spring carriage 320 is between anchor plate 260 and housing 240. Spring carriage 320 is mounted in cutout 263. Spring carriage 320 attenuates motions other than in the primary load direction between anchor plate 260 and housing 240. In other words, spring carriage 320 prevents rattling. Spring carriage 320 has a unshaped body 322 that has legs 324, 326 and a bottom portion 328. An opening 330 is located between legs 324 and 326. A spring tab 332 extends into opening 330.

Four spring fingers 340 are mounted to body 322. One spring finger is located at each corner of body 322. Spring fingers 340 have an upper tang 342 and a lower tang 344. Spring fingers 340 extend from cutout 263 onto the top and bottom surfaces of anchor plate 260. Upper tang 342 is in contact with surface 260A. Lower tang 344 is in contact with surface 260B. Anchor plate 260 is squeezed between tangs 342 and 344.

Spring tab 332 fits into slot 297 and is able to press against spring 290. Spring tab 332 applies a reverse force to spring 290 and assists with overcoming geometrical tolerance issues due to variations in the dimensions of the components. Spring tab 332 also assists with alignment of spring 290 with respect to housing 240. A bar 346 extends over magnet carrier 302. Bar 346 retains magnet carrier 302 in opening 272.

When a tension is applied to webbing 230, housing 240 moves relative to the fixed anchor plate 260 resulting in the compression of spring 290. As housing 240 moves, hall effect device 282 is moved relative to magnet assembly 300 which is held by spring 400 through anchor plate 260.

As the tension increases, housing 240 will move further in relation to anchor plate 260. This causes the hall effect device 282 to move. At the same time bearing rail 246 slides within slot 306. The total travel distance can be about 1 to 3 millimeters. The hall effect device is located adjacent to magnet 310. A small air gap is located between hall effect device 282 and magnet 310. The hall effect device outputs an electrical signal that is proportional to the flux density of the perpendicular magnetic field that passes through the device. Since, the magnets have a north and south pole, the strength of the magnetic field varies as the polarity changes from one pole to the other along the length of the magnet.

Therefore, the resulting electrical output signal of the hall effect devices changes in proportion to the amount of tension in webbing 230. This electrical signal is processed by electronic circuitry and provided to an external electrical circuit through terminals 256 to a conventional controller. The controller can then use the tension information to compute a more accurate profile of the user 17 and use that information to control the game/exercise video.

The movement of housing 240 relative to the fixed anchor plate 260 is limited by the interaction of flange 243 with edges 265A and 265B. In a resting position with no tension placed on webbing 230, spring 290 applies a force between arm 268 and wall 296 which results in the flange 243 moving into contact with edge 265B. After flange 243 touches edge 265B, housing 240 can no longer move toward end 261 of anchor plate 260. This position is defined as a rest or no tension position.

As tension is applied to webbing/spring 230, housing 240 will move away from end 261 of anchor plate 260 and spring 290 will start to be compressed. Housing 240 will move relative to anchor plate 260 and therefore hall effect device 282 will move relative to magnet 310.

As further tension is applied to webbing 230, flange 243 will move into contact with edge 265A. After flange 243 touches edge 265A, housing 240 can no longer move away from end 261 of anchor plate 260. This position is defined as an overload position.

Any further tension applied to webbing 230 after flange 243 engages edge 265B will be transferred to anchor plate 260 and spring 400. The transfer of additional tension prevents further compression of spring 290 and protects magnet assembly 300 and hall effect device 282 from damage due to the possible application of large tension forces. This can be referred to as overload protection.

The use of tension sensor assembly 220 has many advantages. Tension sensor assembly 220 allows for the measurement of tension in a compact package with a small number of components. Tension sensor assembly 220 has a small amount of motion while still being able to determine the amount of tension. Tension sensor assembly 220 has an overload protection mechanism that prevents excessive tension from damaging the sensing components.

The tension sensor of the present invention has additional advantages. It allows accurate sensing of tension, without excessive movement of the webbing. The tension sensor allows a controller to make better decisions based upon more accurate information.

While the housing with an integral connector was shown used in combination with a magnet and magnetic field sensor, any suitable type of sensor can be used with the integral connector. For example a strain gage sensor could be used in combination with an integral connector. Other sensors such as inductive, optical, capacitive or pressure could also be used with an integral connector.

Illustrated Motion Capture System

It is noted that different motion capture systems/sensors exist that could work for sensor motion capture device 21 to be used to capture the motion of the user 16 as a whole body motion, or at least a single body portion. Any of the following four listed systems could be suitable in the present invention and the listed patents in each of the four sections below are herein incorporated by reference for their supportive teachings and technology, wherein:

1. Optical Motion Capture Systems

Optical motion capture systems generally employ reflective patches adhered or sewn to an actor's clothing, and a light shining on the actor. Optical cameras record the reflections from the patches, and a processing system processes the images recorded by the cameras to determine the positions of the patches as the actor moves through a scene. Examples of optical motion capture systems include U.S. Pat. No. 6,580,511 entitled Wavelet-Based Facial Motion Capture for Avatar Animation, and U.S. Pat. No. 6,567,116 entitled Multiple Object Tracking System. The former patent incorporates wavelet transforms for feature detection and tracking Optical motion tracking systems are limited to line-of-sight operation. Once a particular patch has been hidden from view by an actor's movement and the patch then reemerges into view, an operator must generally identify for the system by hand the reappeared patch. These type of sensors are especially good sensing whole body motion.

2. Electromagnetic Tracker Systems

Electromagnetic trackers generally work on the principle that a tag creates an electromagnetic field around it, or induces disturbances in an electromagnetic field which has been induced across the capture zone. Examples of Magnetic Field motion capture systems include U.S. Pat. No. 6,549,004 entitled Distributed Magnetic Field Positioning System Using Code Division Multiple Access, and U.S. Pat. No. 6,400,139 entitled Methods and Apparatus for Electromagnetic Position and Orientation Tracking with Distortion Compensation. The former patent uses code division multiple access (CDMA) to distinguish between beacons, purportedly allowing for larger capture zones and reduced interference. These type of sensors would be good to sense whole body motions.

3. Electromechanical Devices and Suits

Electromechanical devices and suits generally employ electromechanical sensors such as potentiometers to capture at least movements such as rotations of joints. The sensors can be connected by wires to the processing system, or the output of the sensors can be transmitted via a wireless connection. Electromechanical suits have been widely used in virtual reality simulation systems. Examples of electromechanical motion tracking systems include U.S. Pat. No. 6,563,107 entitled Topological and Motion Measuring Tool, and U.S. Pat. No. 6,070,269 entitled Data-Suit for Real-Time Computer Animation and Virtual Reality Applications. Electromechanical systems are often bulky and obtrusive, and are not well suited for tracking the relative movement of independent objects.

Several radio frequency (RF) systems have also been proposed. U.S. Pat. No. 6,204,813 purports to describe a radio frequency positioning system that determines identity and positional data of numerous objects. The system includes a plurality of spread-spectrum radio transceivers where at least one transceiver is positioned on each of the numerous objects. At least three spread-spectrum radio transceivers transmit to and receive signals from the plurality of radio transceivers. A signal processor is coupled to the spread-spectrum radio transceivers and determines the identity and the positional data of the objects.

In Operation

In operation of one embodiment of the invention, a user 16 turns on the system 10. The display module 80 displays the game/exercises to be performed using the trampoline 22. The user performs movements/exercises on the trampoline 22, and the data from all or some of the exemplary sensors 220, 21, 12, 13, 17, 19 are sent to the computer system 11. The computer system 11 processes the sensor data and conditions the data to display pixel data that is sent to the display module 80, which shows the avatar 85 of the user 16 thereon.

The computer system, in one embodiment, may receive the sensor data to a videogame interface 50 that is designed to convert the sensor data to typical input data from control devices 27. Most game systems are programmed to receive control devices 27 and not sensors, that is why an interface for video games 50 is implement in this embodiment, to convert the sensor data to known input data. Whereby, the conditioned data is sent, via line 90, to a computer 30, where the typical videogame program 45 is located. The computer 30 again may be a specialty computer, like a wii, Nintendo, Playstation, or it could be a generic computer as discussed in FIG. 3.

Motion Capture System Embodiment

Figure 9:
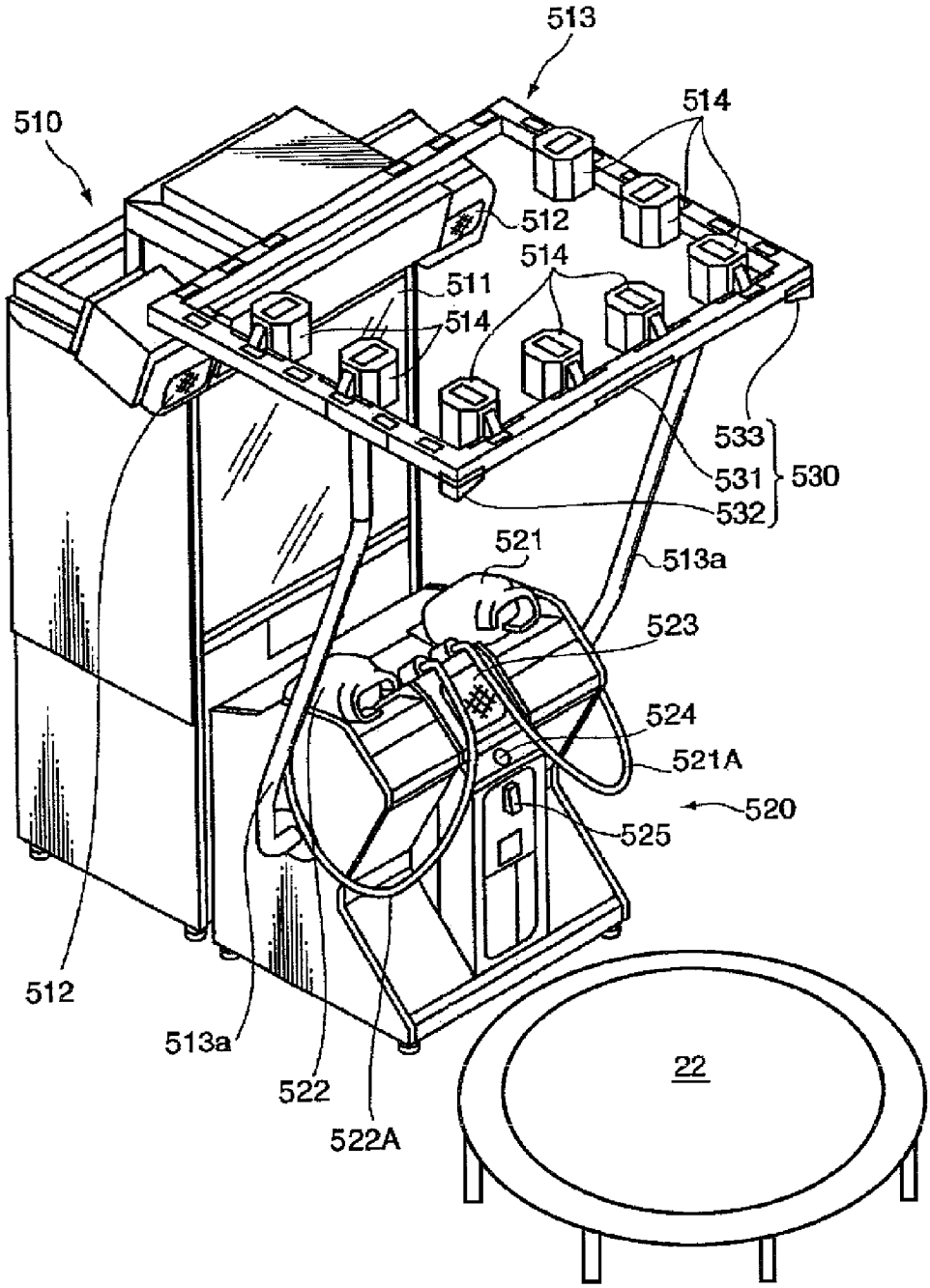
FIG. 9 is a perspective illustration of a three dimensional sensor device and body mounting sensors that may be used in one embodiment of the invention.
Figure 10:
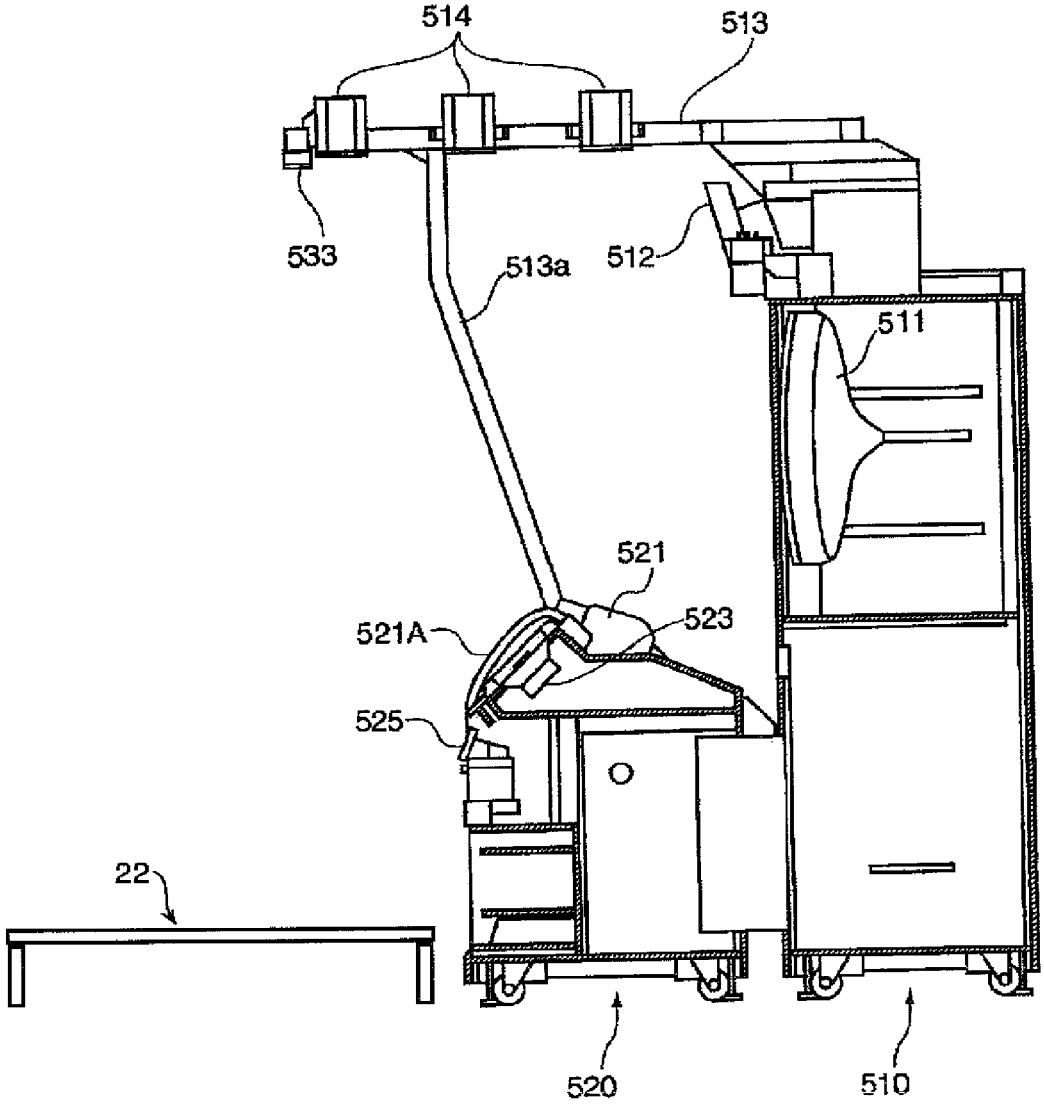
FIG. 10 is a side view of FIG. 9, according to one embodiment of the invention.

FIG. 9 is a perspective view showing one embodiment of the virtual three-dimensional (3D) video position sensing device pertaining to the present invention, and FIG. 10 is a side view thereof. This video position sensing device comprises a video position sensing machine main unit 510, an operation unit 520 that is either permanently or detachably mounted to the front of the main unit or is provided separately from the main unit, and a head detection unit 530, wherein the area in front of the operation unit 520, i.e., the area underneath the head detection unit 530, is a play space in which the player is positioned and the video position sensing device is operated.

It is noted that the illustrated embodiment discusses the use of a head detection unit 530, wherein most any body part can be detected and have a detection unit. Specifically, you can have a foot detection unit, upper leg detection unit, a lower leg detection unit and so forth. For simplified description, avoiding redundancy, and by way of example only, the following description will focus on the sensors involved with the head and hands.

Additionally, it is noted that the description discusses playing a game, wherein the device can be used for any number of functions. Specifically, exercise activities are especially desirable to be done using this device. One skilled in the art will envision many uses thereof, but for the purpose of writing simplicity, reference throughout will be made to game play and such.

The video position sensing machine main unit 510 may be a console box configured essentially as a rectangular parallel piped. On it is mounted a monitor 511 of a prescribed size to display video position sensing images approximately in the center of the front surface of the main unit and preferably at a height such that, for example, the head of the player is roughly at the center of the image when the player is operating the game when he adopts a normal posture while standing on the trampoline 22. For the monitor 511, a CRT, LCD or plasma display, or a liquid crystal projector or similar device, may be used. At the top of the video position sensing machine main unit 510, preferably at the right and left sides thereof, are mounted speakers 512, to reproduce sound effects, and between them is located a panel that displays the name of the game or other information. Inside the video position sensing machine main unit 510 is located a circuit board on which are formed controllers, etc. that are necessary to control the operation of the game. In addition, a square framework 513 extends forward toward the player from the top of the video position sensing machine main unit 510 like the visor of a cap, and support arms 513*a* are formed between appropriate locations on the right and left segments of the framework and the side surfaces of the operation unit 520. A prescribed number of illuminating light sources 514 of the three primary colors, for example, are formed on the frame segments of the framework 513 such that they face the video position sensing machine main unit.

Figure 11:
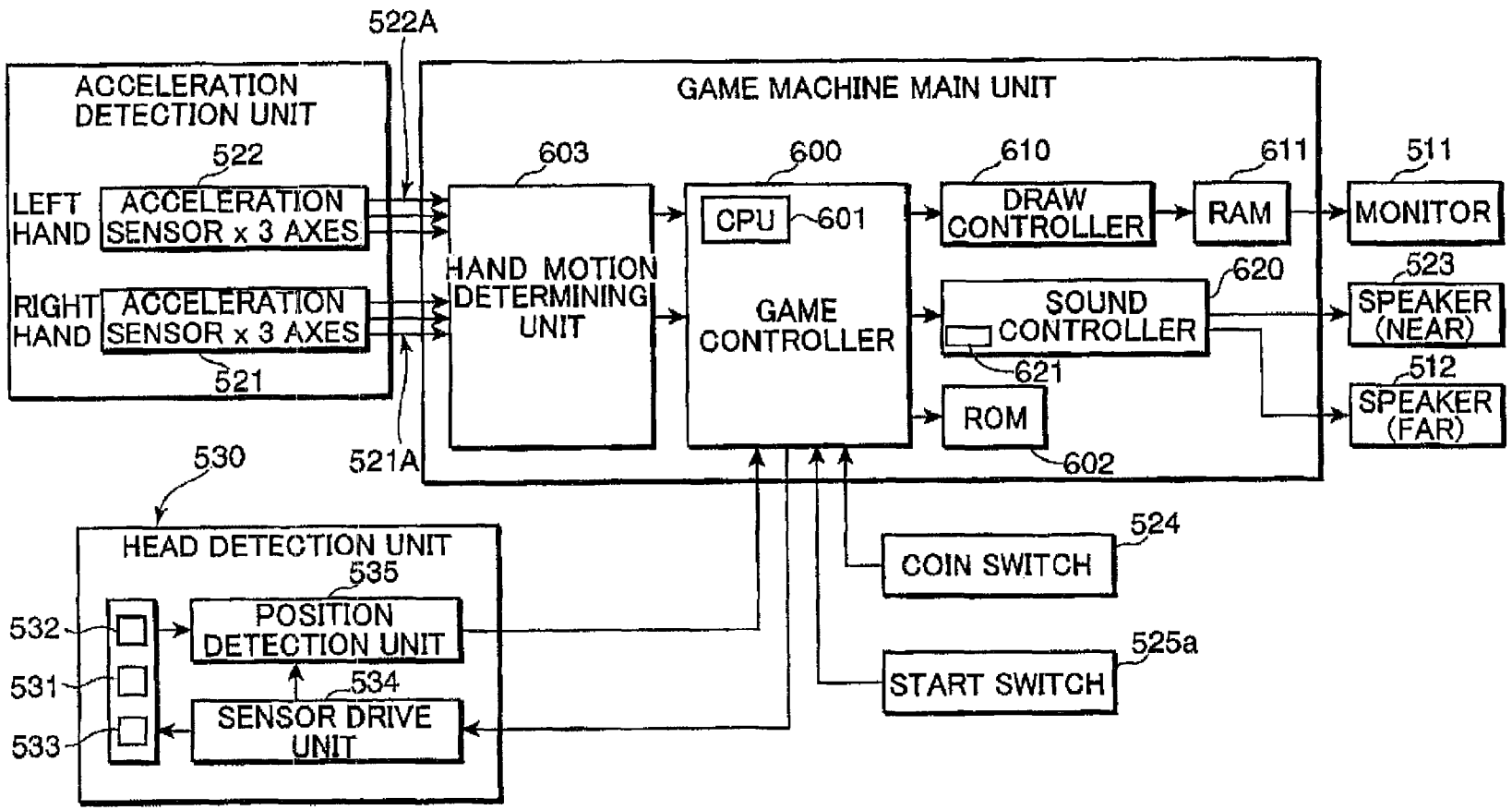
FIG. 11 is a block diagram of hardware/software/mechanical components, according to one embodiment of the invention relating to FIGS. 9 and 10.

The framework 513 functions as a support structure for the head detection unit 530. The head detection unit 530 comprises an ultrasonic transmitter 531 that is located in the lengthwise center of the front frame segment of the framework 513 and that transmits sonic and ultrasonic waves as a communication medium, and ultrasonic receivers 532 and 533 that receive these ultrasonic waves that serve as a communication medium and which are located such that they are horizontally symmetrical relative to the ultrasonic transmitter. Alternatively, light, particularly infrared light, may be used as the communication medium. The ultrasonic transmitter 531 and the ultrasonic receivers 532 and 533 all comprise piezoelectric elements, etc. The ultrasonic transmitter 31 has a directional width sufficient to cover the trampoline bouncing play space, and transmits ultrasonic pulses of a prescribed width at prescribed cycles, for example, in cycles of 1/60.sup.th of a second, or at cycles that enable changes in the position of the player's head, for example, to be tracked at a desired resolution. The ultrasonic receivers 532 and 533 have identical constructions, and have a directional width sufficient to enable them to receive ultrasonic waves that are transmitted by the ultrasonic transmitter 531 and reflected off the head of the player located in the trampoline play space. Inside the head detection unit 530 are located, as shown in FIG. 11, a sensor drive unit 534 that supplies drive signals (periodic excitation pulse signals) to the ultrasonic transmitter 531 and a position calculation unit 535 that is connected to the sensor drive unit 534 and the two ultrasonic receivers 532 and 533 and that calculates the position of the player's head within the trampoline play space. Alternatively, the sensor drive unit 534 and the position calculation unit 535 may be located inside the video position sensing machine main unit 510.

The operation unit 520 is positioned at a height lower than that of the monitor 511. It includes a speaker 523 that reproduces sound effects and that is located in the center of the slightly slanted upper front surface of the operation unit 520 facing the player, i.e., at a position closer to the player than the speakers 512, and a pair of hand sensor units 521 and 522 that are located near the speaker 523 and are designed to have the hands inserted therein, and which function as game controllers and may be mounted via cords 521A and 522A that also serve as control signal transmission lines. When unused, the hand sensor units 521 and 522 are housed in prescribed locations on the top surface of the operation unit 520. While they are in use, i.e., during the game/exercise, they are grasped by the player and are moved around to control the avatar on the screen, as described below. A start switch 524 and an optional coin inlet 525 are also located on the front surface of the operation unit 520. A coin switch 525*a* (see FIG. 9) that detects the existence of an inserted coin is located partway through the coin channel that connects to the coin inlet 525.

It is noted regarding FIGS. 9 and 10 illustrate the trampoline 22 to be in a certain position; wherein the trampoline may need to be located closer under and to the motion capture system 510. For example, as described, it is possible to move operation unit 520 away from the sensing machine main unit 510, thus allowing the trampoline 22 to be moved closer. However, for illustrative purposes, the trampoline 22 is illustrated in its current position.

FIG. 11 is a block diagram of the video position sensing device. On the circuit board located inside the video position sensing machine main unit 510 are located game controllers 600, a screen draw controller 610 and a sound controller 620. The game controller 600 includes a microcomputer (hereinafter referred to as a CPU) 601, for example, which controls the processing of the game action. Connected to the game controller 600 is a ROM 602 that serves as a recording medium to store the game program and necessary game images comprising the game, as well as various other necessary units in addition to the head detection unit 530. Alternatively, a CD-ROM, optical disk, floppy disk, DVD, etc., may be used as the recording medium.

The draw processing unit 610 performs processing to (i) calculate, from the viewpoint of the virtual camera in a virtual three-dimensional space, the coordinate position of each object (i.e., the opponent character, referee character, and player character (which appears in the 'objective viewpoint routine' display described below), the trampoline, the trees, the roads, the rivers, etc.), (ii) calculate the light source for the required object, (iii) calculate the conversion of the calculated coordinate positions in the virtual three-dimensional space to coordinate positions in a two-dimensional space and position the polygons comprising the image to be drawn in the display area of the RAM 111, and (iv) perform texture mapping for each polygon. For the virtual camera viewpoint information used for character coordinate position calculation, the position information transmitted from the head detection unit 530 is used as described below. Therefore, the virtual camera viewpoint essentially matches the view seen by the player (subjective viewpoint routine'), and the character corresponding to the player is basically not displayed on the screen of the monitor 511.

The sound controller 620 reads out from the sound source data memory unit 621 in response to the game action sound source data already loaded into the game program, and drives either the speakers 512 or the speaker 523 to output the associated sound. As the sound source data, the various sounds heard at a virtual world, such as bird, air, river noise, etc. are loaded as sounds associated with viewpoints. The sound source data is stored in the PCM data format, for example, and after it is read out, it undergoes D/A conversion, filtering and amplification and is output as sound to the speakers 512 or the speaker 523. The sound controller 620 also has a unit that performs processing to selectively alternate the sound output between the speakers 512 and 523 based on the distance to the viewpoint of the virtual camera, as described below.

In this game, the CPU 601 has a function to determine whether or not to deem a hand motion from the user as having moved on the player, and this determination is made with reference to the relationship from the viewpoint position of the virtual camera. Furthermore, the CPU 601 also has functions to (i) reduce the life gauge by a prescribed amount when the player exercises over time, and (ii) determine whether the life gauge has fallen to zero (0).

Figure 13A:
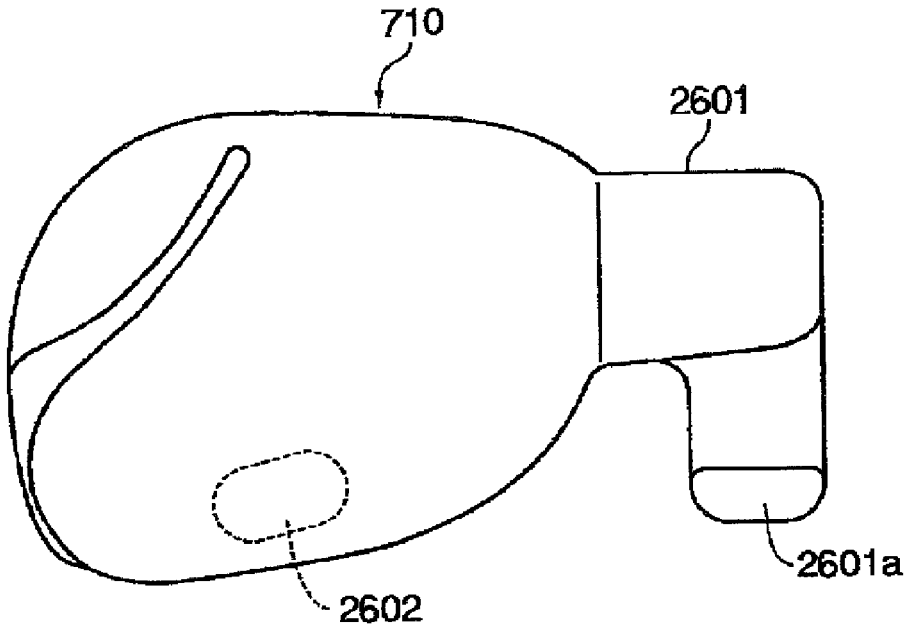
FIGS. 13A and B are illustrations of a glove with motion sensors located therein of one embodiment of the invention for using in FIGS. 9-12.
Figure 13B:
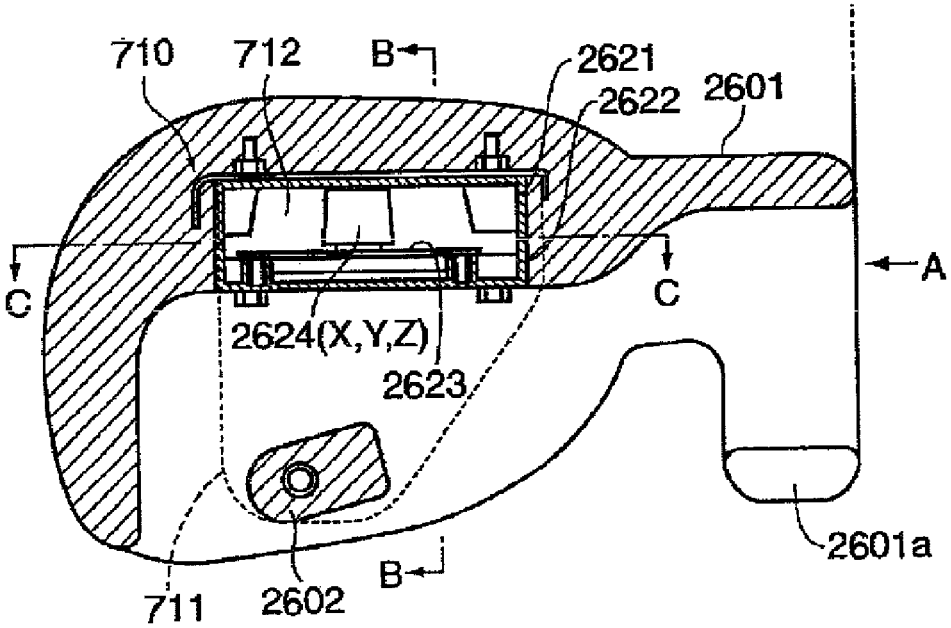
Figure 14A:
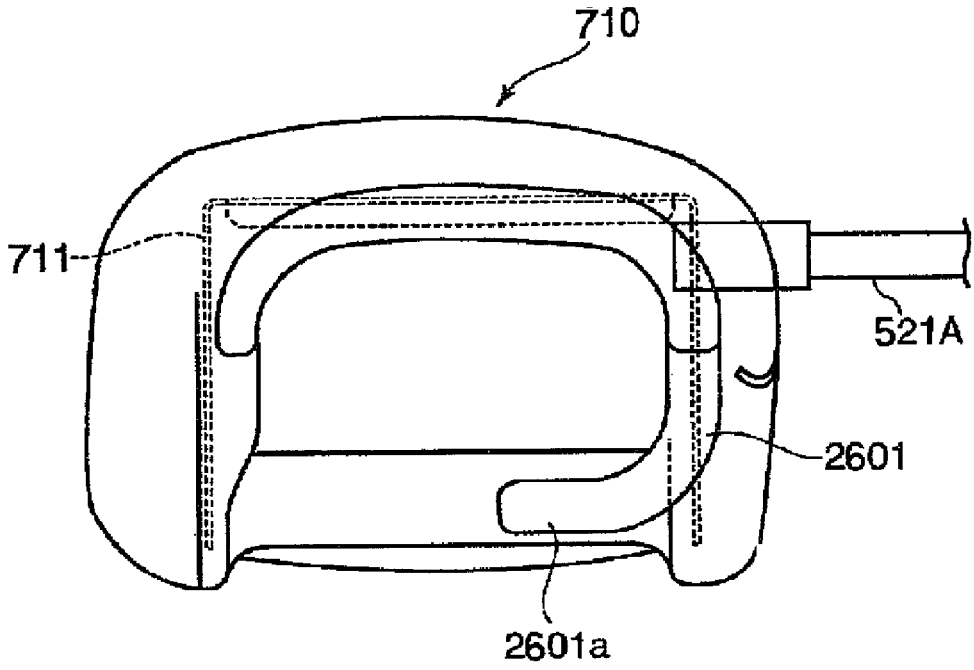
FIGS. 14A and B are illustrations of a glove with motion sensors located therein of one embodiment of the invention for using in FIGS. 9-13.

The construction and operation of the hand sensor units 521 and 522 will now be explained with reference to FIGS. 13 through 15, using the right hand sensor unit 521 as an example. FIG. 13A is a side view, FIG. 13B is a side cross-sectional view, FIG. 14A is a view of FIG. 13B from the direction of the arrow A, FIG. 14B is a cross-sectional view of FIG. 13B cut along the B-B line, and FIG. 15 is a cross-sectional view of FIG. 13B cut along the C-C line.

The hand sensor unit 521 is formed from resin or a similar substance, and has the same external configuration as a hand sensor used in wearing a glove. The hand sensor unit 521 has a main section 710 in which the hand is inserted, and formed therein is a fixing area 2601 that fixes the player's wrist in the proper position. The main section 710 has side walls of a prescribed thickness at the upper part (back of the hand), the tip part (the area that comes into contact with the fingers), and the right and left parts (the areas that come into contact with the thumb and pinky finger) thereof, while the bottom part is open. Located at an appropriate location at the center lower part of the main section 710 is a rod-shaped holding member 2602 that extends across from the right side wall to the left side wall. The fixing area 2601 has a wrapping part 2601*a* that wraps around the wrist from the bottom thereof, as shown in FIG. 13A, so that the hand sensor 521 will not rotate freely around the holding member 2602 and slip off of the hand. The hand glove may be made of soft material except for the actual sensor that needs to be more robustly protected, in which it would be protected by a more sturdy plastic, for example.

Figure 14B:
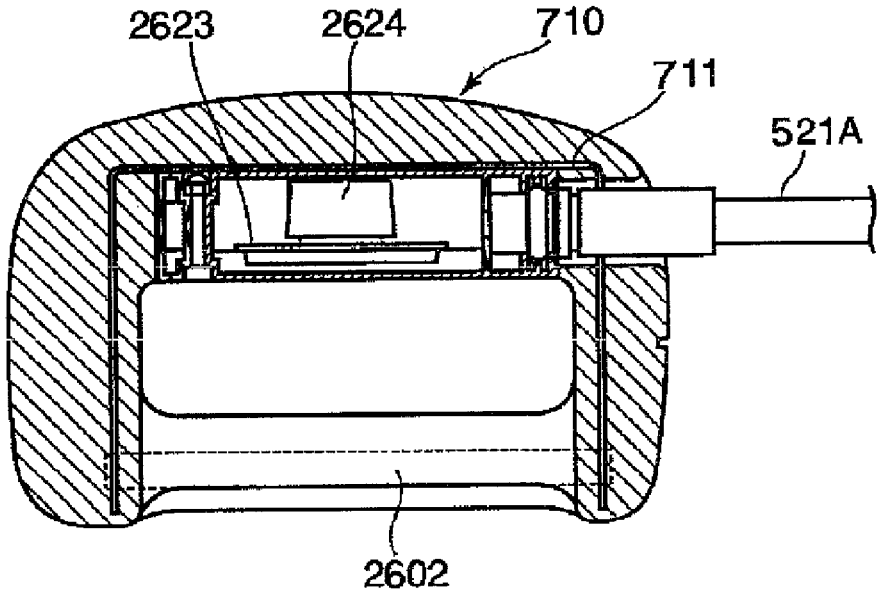
Figure 15:
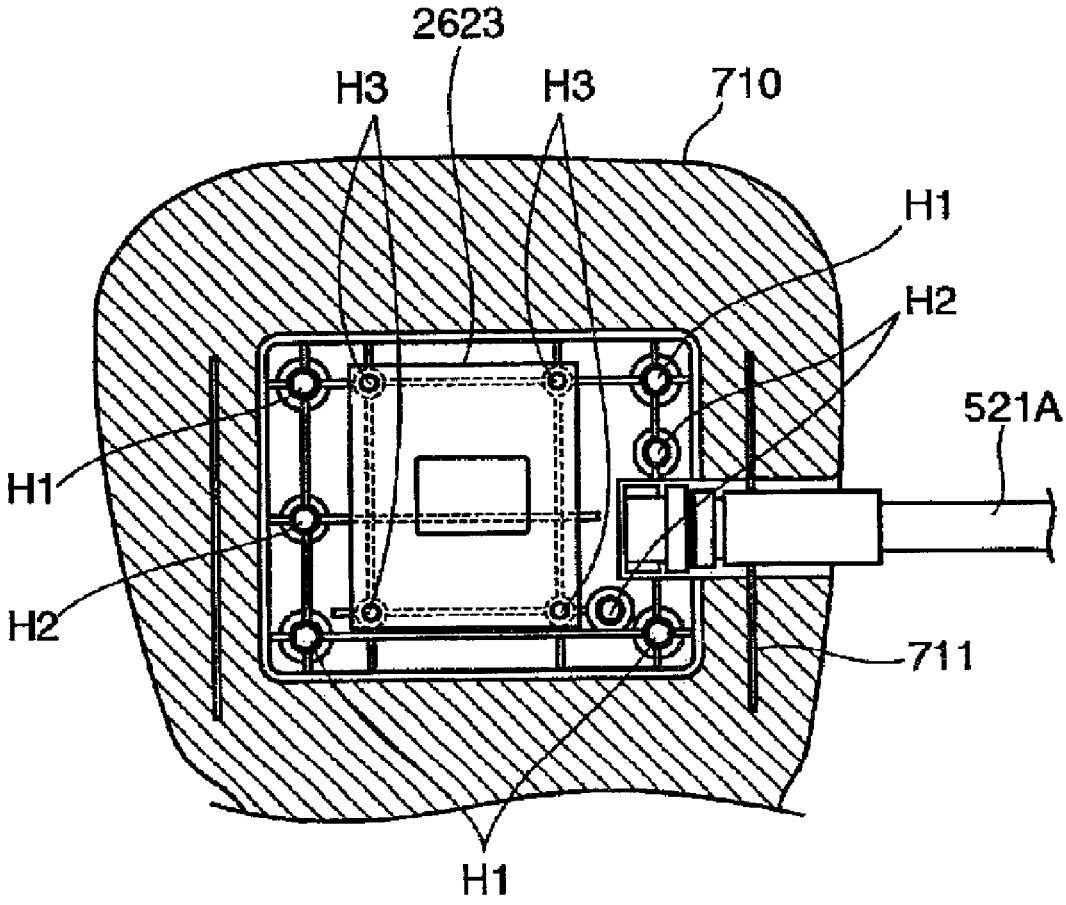
FIG. 15 is an illustration of a glove with motion sensors located therein of one embodiment of the invention for using in FIGS. 9-14.

As shown in FIG. 14B, a plate member 711 comprising a U-shaped metal member having walls at the top and the right and left thereof is embedded in the upper part and the right and left parts of the main section 710. Part of the interior of the top plate forming the plate member 711 comprises an empty space containing no resin, and an acceleration sensor unit 712 is housed in this empty space as a motion detection unit. In other words, the hand sensor unit 521 is formed through the infusion of resin into a mold into which the plate member 711 is already set.

The acceleration sensor unit 712 has upper and lower casings 2621 and 2622 comprising the top and bottom parts of a rectangular parallelepiped box, and inside the acceleration sensor unit 712 is housed a sensor substrate 2623 and a sensor 2624 that is mounted on the sensor substrate 2623. As shown by the bolt holes in FIG. 15, the upper casing 2621 is fixed to the plate member 711 beforehand by screwing nuts to the bolts placed thereon (bolt holes H1), and the lower casing 2622 is fixed to the upper casing 2621 (bolt holes H2) by screws. The sensor substrate 2623 is fixed to the lower casing 2622 (bolt holes H3) by screws. It is also acceptable if a process is adopted in which the upper and lower casings 2621 and 2622 are assembled and then mounted to the plate member 711. Alternatively, a different public-domain method may be used to connect the components together.

Figure 16:
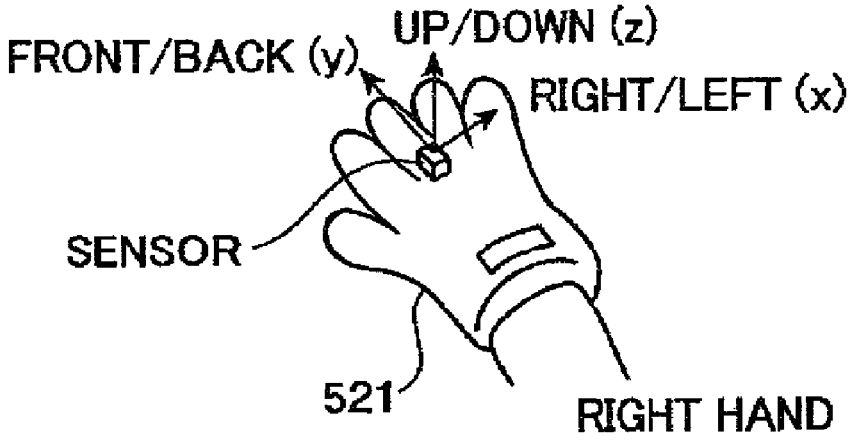
FIG. 16 is an illustration of a glove with motion sensors located therein of one embodiment of the invention for using in FIGS. 9-15.

The sensor 2624 houses an acceleration sensor that can detect movement components along three axes, and when acceleration occurs, it outputs level voltage for each axial direction component in accordance with the acceleration. This embodiment includes, as shown in FIG. 16, functions equivalent to a sensor Y that individually detects acceleration in the tip direction (front/back direction (y)) of the hand sensor unit 521, a sensor X that individually detects acceleration in the right/left direction (x), and a sensor Z that individually detects acceleration in the up/down direction (z). It is also acceptable if a construction is adopted in which individual acceleration sensors are employed for each axial direction.

Figure 17:
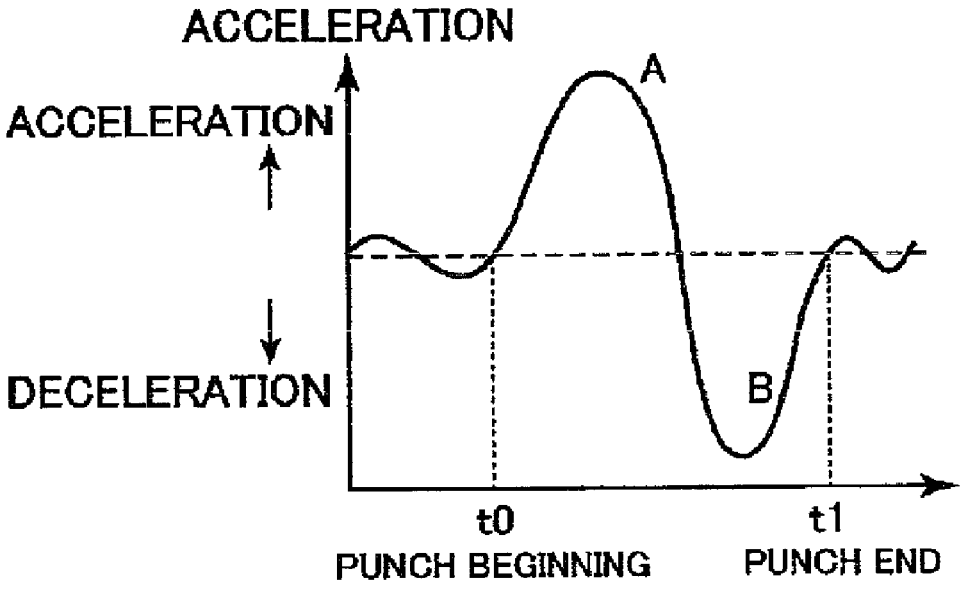
FIG. 17 is an illustration of a graph related to the motion sensors located in the glove of one embodiment of the invention for using in FIGS. 9-16.

FIG. 17 is a waveform graph for the sensor 2624. When a hand movement occurs, a positive acceleration normally occurs at the beginning of the action (time t0), and after the peak acceleration is reached, the rate of acceleration begins to decrease, changing into negative acceleration at the point at which the arm is completely extended, and finally at time t1, the rate of acceleration returns to 0. Because the arm is generally always in motion to some extent, the beginning of a hand movement is determined in the manner described below.

The hand movement determining unit 603 shown in FIG. 11 determines the type of hand movement from the detection waveforms from the sensors X, Y and Z, and has a memory that at least sequentially stores the waveforms output from the X, Y and Z sensors during the prescribed immediately preceding period of time. The types of hand movements are a straight hand movement, a right hand movement if the hand sensor unit 521 is used (a left hand movement if the hand sensor unit 522 is used), and an upper hand movement. The hand movement determining unit 603 detects the constant acceleration for each sensor X, Y and Z after the game is begun. Here, with regard to the sensor Y, 1 where a large value is suddenly input, 2 the hand movement determining unit 603 travels backward on the waveform to detect the point in time at which the value was close to 0, and determines this point to be time t0. 3 Subsequently, after a small value is suddenly obtained, 4 the hand movement determining unit 603 detects the point in time at which the value was subsequently close to 0, and determines this point to be time t1. Alternatively, a prescribed number of seconds may be set beforehand as the interval t0 to t1.

If the times t0 and t1 are determined in this way, the type of hand movement is determined through analysis of the waveforms of the sensors X and Z during this interval. While it is acceptable to perform waveform analysis, in view of time restrictions, the following method is preferred. In this method, data such as the maximum and minimum values in the waveform during the t0-t1 interval (a positive value detected immediately before the acceleration turns negative (an extreme value); a detected negative value detected immediately before the acceleration turns positive (an extreme value)), the waveform amplitude (the difference between the maximum and minimum values above), the number of waveform peaks (the number of extreme values), and the waveform integral value (the total of the detected values at each detection time) are extracted from outputs from the sensors X, Y and Z, and the type of hand movement is determined from these various items of data.

Figure 18A:
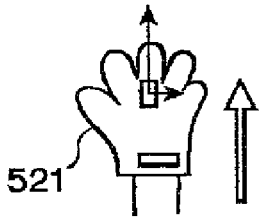
FIGS. 18A, B and C illustrate the operation of sensing forward motion of a glove sensor, according to one embodiment of the invention regarding FIGS. 9-17.
Figure 18B:
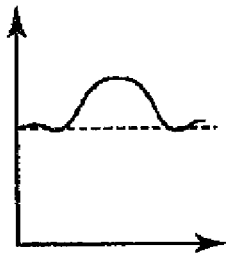
Figure 18C:
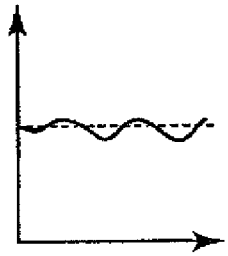

FIGS. 18 through 20 show the relationship between the type of hand movement and the waveform output from each sensor X, Y and Z. FIG. 18 shows a straight hand movement, as shown in FIG. 18A. Here, the sensor Y exhibits the waveform shown in FIG. 17, the sensor X exhibits a waveform in which some positive acceleration occurs due to the fact that the hand movement travels some distance sideways from the player's body, as shown in FIG. 18B, and as shown in FIG. 18C, the sensor Z exhibits a waveform with essentially no change in output because there is no real change in acceleration in a vertical direction.

Figure 19A:
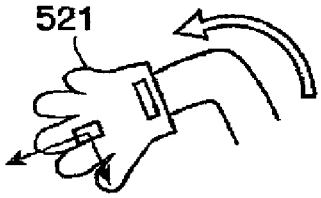
FIGS. 19A, B and C illustrate the operation of sensing side ways like motion of a glove sensor, according to one embodiment of the invention regarding FIGS. 9-18.
Figure 19B:
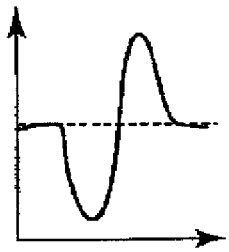
Figure 19C:
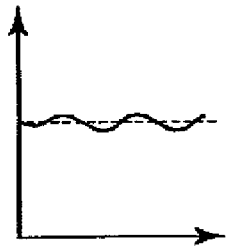

FIG. 19 shows a right hand movement, as shown in FIG. 19A. Here, the sensor Y exhibits the same basic waveform as shown in FIG. 17, while the sensor X exhibits a waveform in which, because the fist moves as if it were swallowed by the inside of the opponent character's body, acceleration toward the inside direction (negative acceleration in terms of the right/left direction x) occurs when the action is begun, after which positive acceleration occurs, as shown in FIG. 19B. As shown in FIG. 19C, the sensor Z exhibits a waveform with essentially no change in output because there is no real change in acceleration in a vertical direction.

Figure 20A:
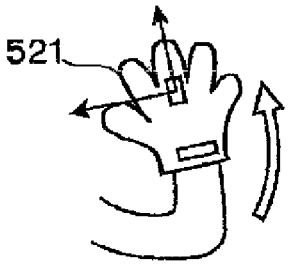
FIGS. 20A, B and C illustrate the operation of sensing upward motion of a glove sensor, according to one embodiment of the invention regarding FIGS. 9-19.
Figure 20B:
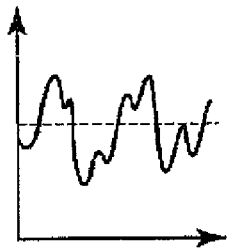
Figure 20C:
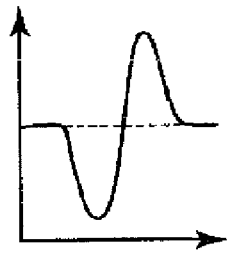

FIG. 20 shows an upper hand movement, as shown in FIG. 20A. Here, the sensor Y exhibits the same basic waveform as shown in FIG. 17, but because the hand movement traces a circular arc when it is moved, as in the case of a side ways movement, but unlike a sideways motion, the palm of the hand faces the front of the player and the hand movement is executed, the sensor X exhibits a waveform in which large negative acceleration first occurs in the z direction, whereupon positive acceleration occurs, as shown in FIG. 20C. With regard to the sensor Z, acceleration in the right/left direction is unstable, and thus the waveform is rather shapeless, as shown in FIG. 20B.

The hand movement determining unit 603 determines the type of hand movement by converting the waveform patterns shown in FIG. 17 and FIGS. 18 through 20 into the data for the maximum and minimum values, the waveform amplitude, the number of waveform peaks, the waveform integral values, etc. The result of this determination is supplied to the game controller 600.

Figure 12:
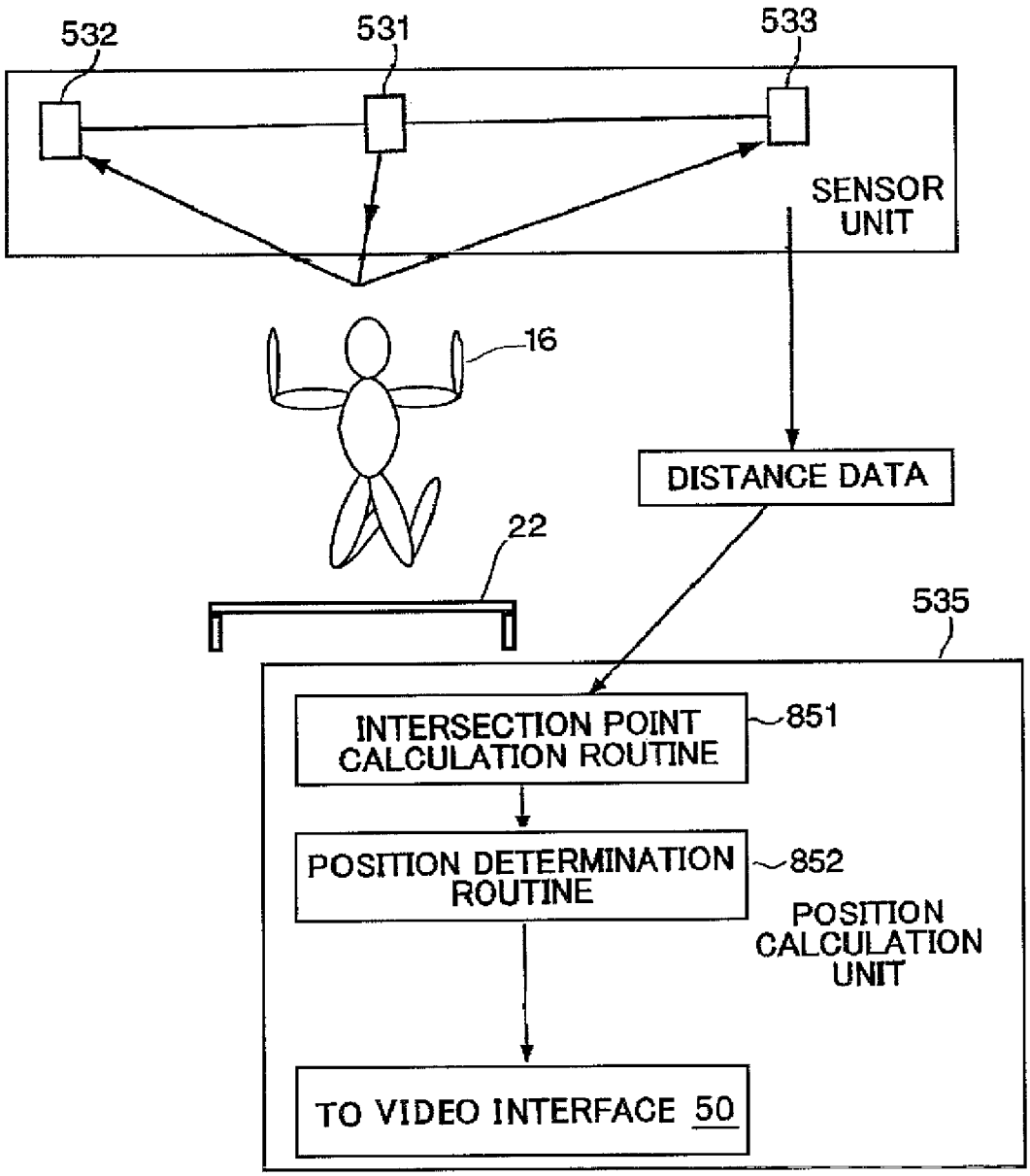
FIG. 12 is a block diagram of key components of one embodiment of the invention relating to FIGS. 9, 10, and 11.

Next, the detection principle employed by the position calculation unit 535 of the head detection unit 530 will be explained with reference to FIG. 12. Wide-angle directional ultrasonic pulses transmitted by the ultrasonic transmitter 531 are reflected off the player's body located below the transmitter, and some of these pulses are received by the ultrasonic receivers 532 and 533. Because during normal play, the player's head is the highest part of the body, the pulse signals received by the receivers 532 and 533 may be deemed as returning signals reflected off the head of the player. The position calculation unit 535 (i) clocks, for each ultrasonic receiver 532 and 533, the time elapsed between the time the pulse is sent and the time that the pulse signal received by the ultrasonic receiver rises, (ii) performs various geometric calculation processes using the distance data obtained through conversion of both clocked times based on the atmospheric propagation sound velocity, as well as information regarding the distances between the ultrasonic transmitter 531 and the ultrasonic receivers 532 and 533, and regarding their height, and (iii) calculates the position of the player's head in the vertical direction and in the right/left direction. In other words, the clocked time for the ultrasonic receiver 532 determines an ellipsis with the ultrasonic transmitter 531 and the ultrasonic receiver 532 as foci. Similarly, the clocked time for the ultrasonic receiver 533 determines a separate ellipsis with the ultrasonic transmitter 531 and the ultrasonic receiver 533 as foci. Because the position of the ultrasonic transmitter 531 is the same in either case, the point of intersection comprising the lowest point of the two ellipsoids can be calculated (intersection point calculation process 851), and the position in space in both the vertical direction and the right/left direction can be determined from the height information for the ultrasonic transmitter 531 and the ultrasonic receivers 532 and 533 (position determination process 852). In order to simplify this calculation, the player's head may be deemed to be directly below the ultrasonic transmitter 531 and the ultrasonic receivers 532 and 533, i.e., the intersection point may be calculated using only ellipsis calculation. Furthermore, a construction may be adopted in which the relationship between the two clocked times (i.e., the two items of distance data) and the head position are calculated beforehand and sought, and thereafter stored in the form of a reference table (LUT). The position calculation unit 535 transmits the height position and the right/left position of the player's head within the empty space to the game controller 600 as virtual camera viewpoint information, and also transmits them to the draw controller 610. Therefore, the viewpoint of the virtual camera is shifted in accordance with the position of the player's head, i.e., so as to track the amount and direction of the change in the position of the player's head.

Figure 21:
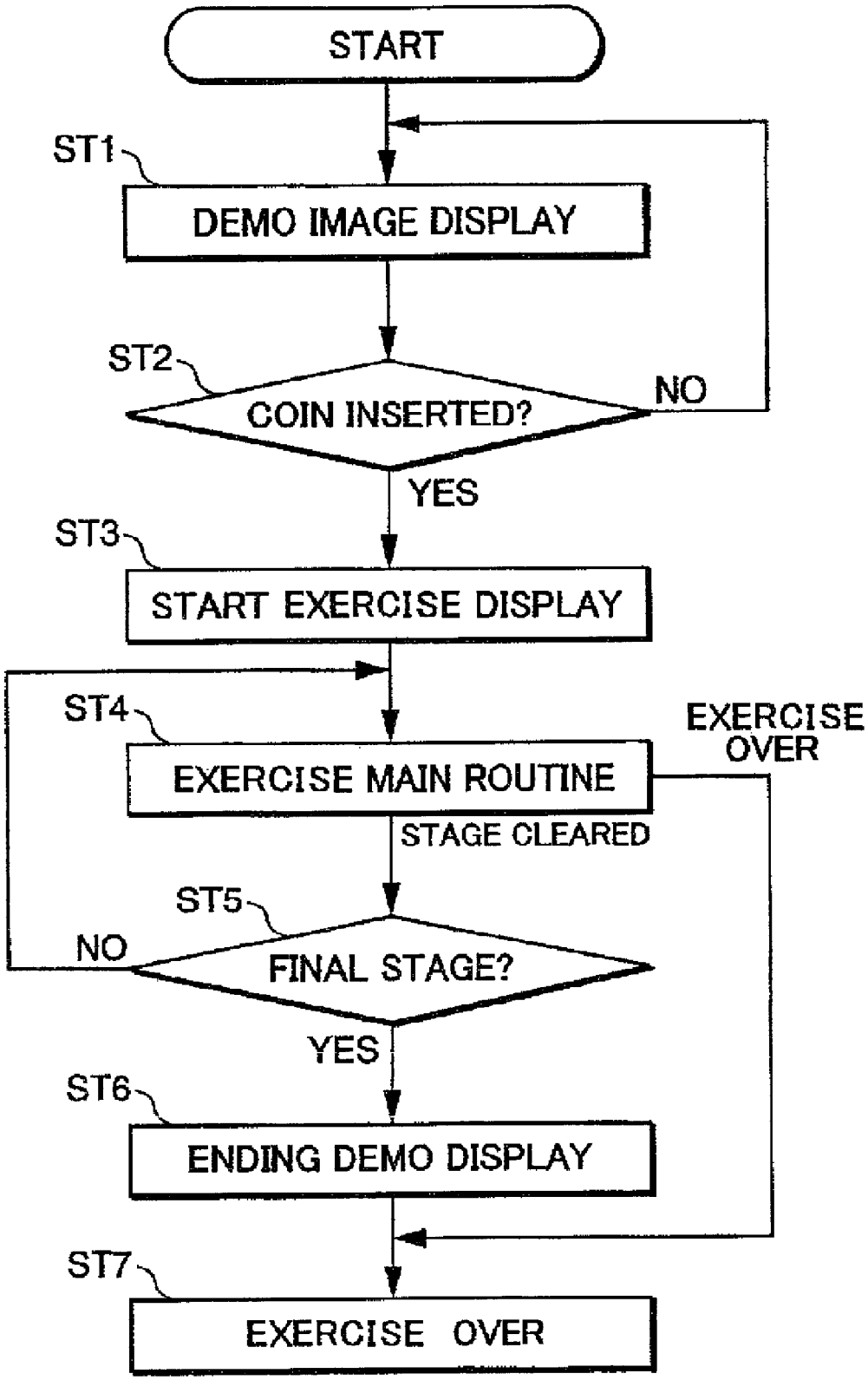
FIG. 21 illustrates a flow diagram of the operation of one embodiment of the invention related to FIGS. 9-20.

FIG. 21 is a flow chart showing an example of the game action routines executed by the CPU 601. When the power is turned ON, the sequence begins. First, the demonstration screen is displayed on the monitor 511 (step ST1). If it is detected by the coin switch 525*a* that a prescribed coin has been inserted, (YES in step ST2), the start screen is displayed (step ST3), and the game main routine is executed as an exercise game (step ST4), for example. Where the game is designed to comprise a prescribed number of stages, it is determined whether or not prescribed conditions have not been fulfilled during each stage, i.e., it is determined, for example, whether or not the life gauge displayed on the monitor 511 through the control of the CPU 601 that functions as a life gauge managing means has fallen to a prescribed level, such as zero, it is determined whether or not the next stage is the final stage (step ST5). Conversely, where the life gauge falls to zero during the game, the display switches to the game over screen at that point, and the game is ended.

On the other hand, if a cleared stage (ending with the player deemed the winner) is the final stage, an ending demo screen representing a victory ceremony is displayed (step ST6), the number of points scored is displayed if necessary, the display is changed to the game over screen (step ST7), and the game ends.

Figure 22:
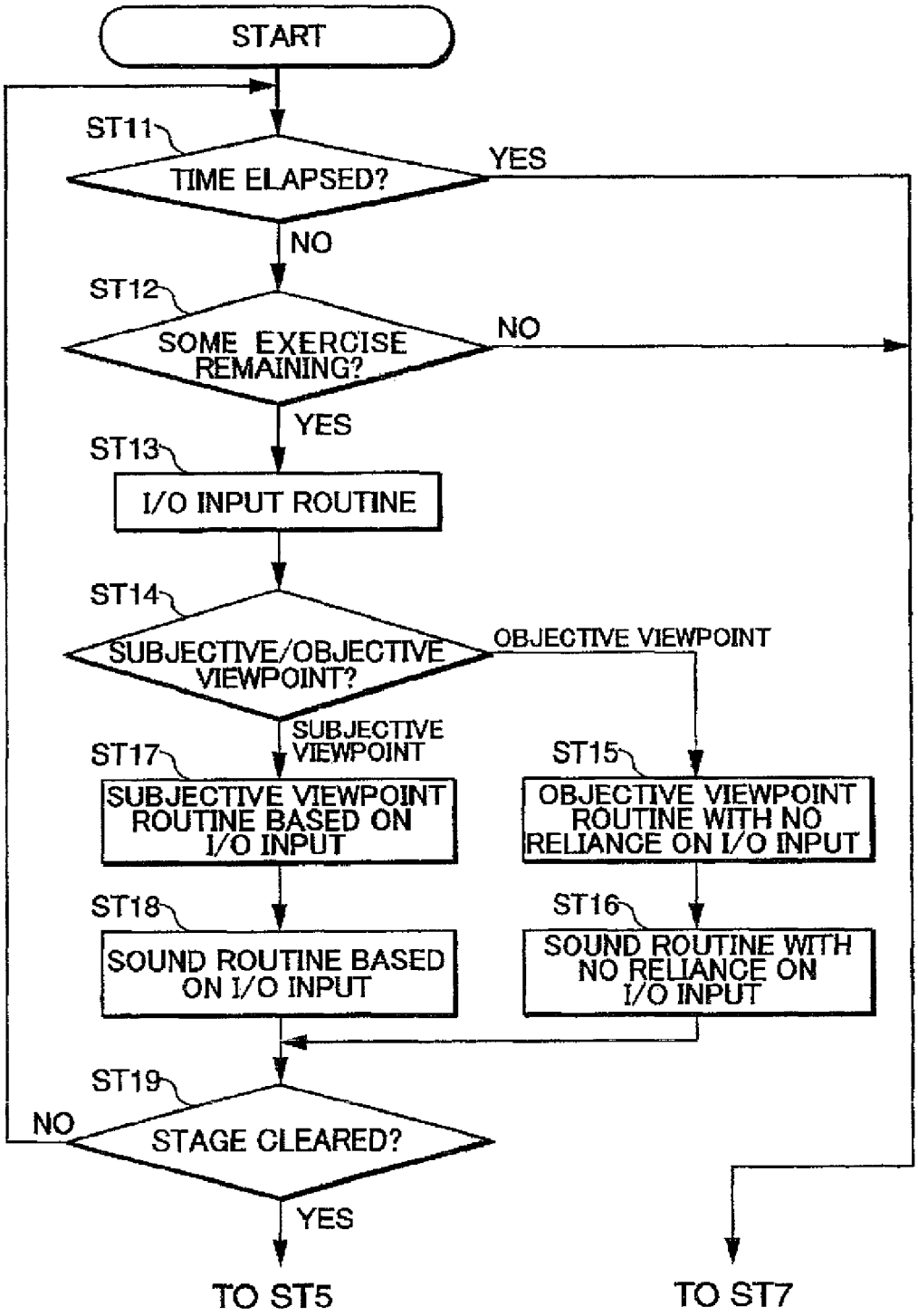
FIG. 22 illustrates a flow diagram of the operation of one embodiment of the invention related to FIGS. 9-21.

FIG. 22 is a flow chart showing the sequence of the 'game main routine' of step ST4. In the game main routine, first, it is determined using an internal timer whether or not the game time set for each stage has elapsed, and if it has not elapsed, it is determined whether or not some life energy remains in the life gauge (steps ST11, ST12). If neither is the case, the CPU 601 shifts to step ST7. On the other hand, if there is some life energy remaining in the life gauge, the I/O input routine, i.e., the routine to receive from the head detection unit 530 information on the position of the player's head, that is, essentially information on the position of the player's eyes, is executed (step ST13).

It is next determined whether or not the viewpoint is a subjective viewpoint or an objective viewpoint (step ST14). In this game, using a timer together with the CPU 601 that functions as a subjective/objective viewpoint switching means, an image of a large scope of view, which is obtained by zooming back the virtual camera to include the player character in the image, is drawn for a certain period of time when each stage begins in order for the player to understand the overall situation regarding the game space, i.e., to understand or recognize where he or she is situated within the game space, and during this period of time, the objective viewpoint routine is carried out. When the draw routine based on this objective viewpoint is completed, the viewpoint switches to the subjective viewpoint using the player's eyes as the standard. In step ST14, if the viewpoint is the objective viewpoint, game action from a viewpoint that does not depend on information obtained in the I/O input routine is drawn together with game images based on this action (step ST15), interrupts for sound control to provide audience noise, etc., occur, and sounds such as cheering are output from the speakers 512 (or both the speakers 512 and the speaker 523) (step ST16).

On the other hand, when the viewpoint is switched to the subjective viewpoint, game action from a subjective viewpoint based on information obtained in the I/O input routine is drawn together with game images based on this action (step ST17), interrupts for sound effects to provide sounds resembling the swishing of air from hand movements and the sounds of feet landing on a trampoline, and the sounds are output from the speaker 523 (step ST18). When the sound routines of steps ST16 and ST18 are completed, it is determined whether or not the current stage has ended, and if it has not ended, the CPU 601 shifts to step ST11 and the sequence from step ST11 to step ST18 is repeated, while if the current stage has ended, the CPU 101 shifts returns to step ST6 and this sequence is no longer followed.

The motion detection unit located in each hand sensor unit 521 and 522 is not limited to an acceleration sensor, and the following constructions may be adopted instead. (1) A construction may be adopted in which a three-axis acceleration sensor as well as an infrared photoemitting element having a required directional width is mounted inside each hand sensor unit 521 and 522, and at the same time, wide directional width infrared photoreceptor elements are mounted to several locations on the video position sensing machine main unit 510, such as the front, diagonally across therefrom, and the top, so that when a hand movement is activated, the loci of hand sensor movement are detected with even higher precision by not only receiving the output from the acceleration sensor, but also by adding to the determination of the type of hand movement the results of the determination of which photoreceptor element received light, or of from which photoreceptor element to which photoreceptor element the received light moves. This would be particularly useful for determining an uppercut.

(2) A construction may be adopted in which (i) a magnetic field generating device is mounted in the video position sensing machine main unit 10, and (ii) a magnetic sensor is incorporated in each hand sensor unit 521 and 522, so that the positions and loci of the hand sensor units 521 and 522 are calculated through detection of the strength of the magnetic field.

(3) A construction may be adopted in which (i) multiple ultrasonic sensors are located on the front of the video position sensing machine main unit 510 such that their receiving sides face forward, and (ii) an ultrasonic emitter is mounted in each hand sensor unit 521 and 522, so that the positions of the hand sensor units 521 and 522 are detected through the receipt by the video position sensing machine main unit 510 of the ultrasonic signals emitted from the hand sensor units 521 and 522, and the loci of the hand sensor units 521 and 522 are calculated from the results of this position detection operation.

(4) A construction may be adopted in which (i) an infrared CCD 3 camera is mounted to the video position sensing machine main unit 10, and (ii) an infrared photoemitting element is incorporated in each hand sensor unit 521 and 522, so that the loci of the hand sensor units 521 and 522 are calculated by specifying the infrared light emission positions via the CCD camera and sequentially storing these positions in memory. Furthermore, instead of mounting photoemitting elements in the hand sensor units 521 and 522, special coatings may be applied to the gloves such that the areas on which the coating was applied are detected using the CCD camera.

(5) A construction may be adopted in which, in addition to incorporating a three-axis acceleration sensor in each hand sensor unit 521 and 522, a tube that contains water or another liquid is located in the wire connected to each hand sensor unit 521 and 522. More accurate position movement detection may be performed through the detection of the height of the surface of this liquid, that is, based on the combination of (i) the results of the detection of the directions of movement of the hand sensor units 521 and 522 by the three-axis acceleration sensor, and (ii) the liquid surface height detection information.

Figure 23:
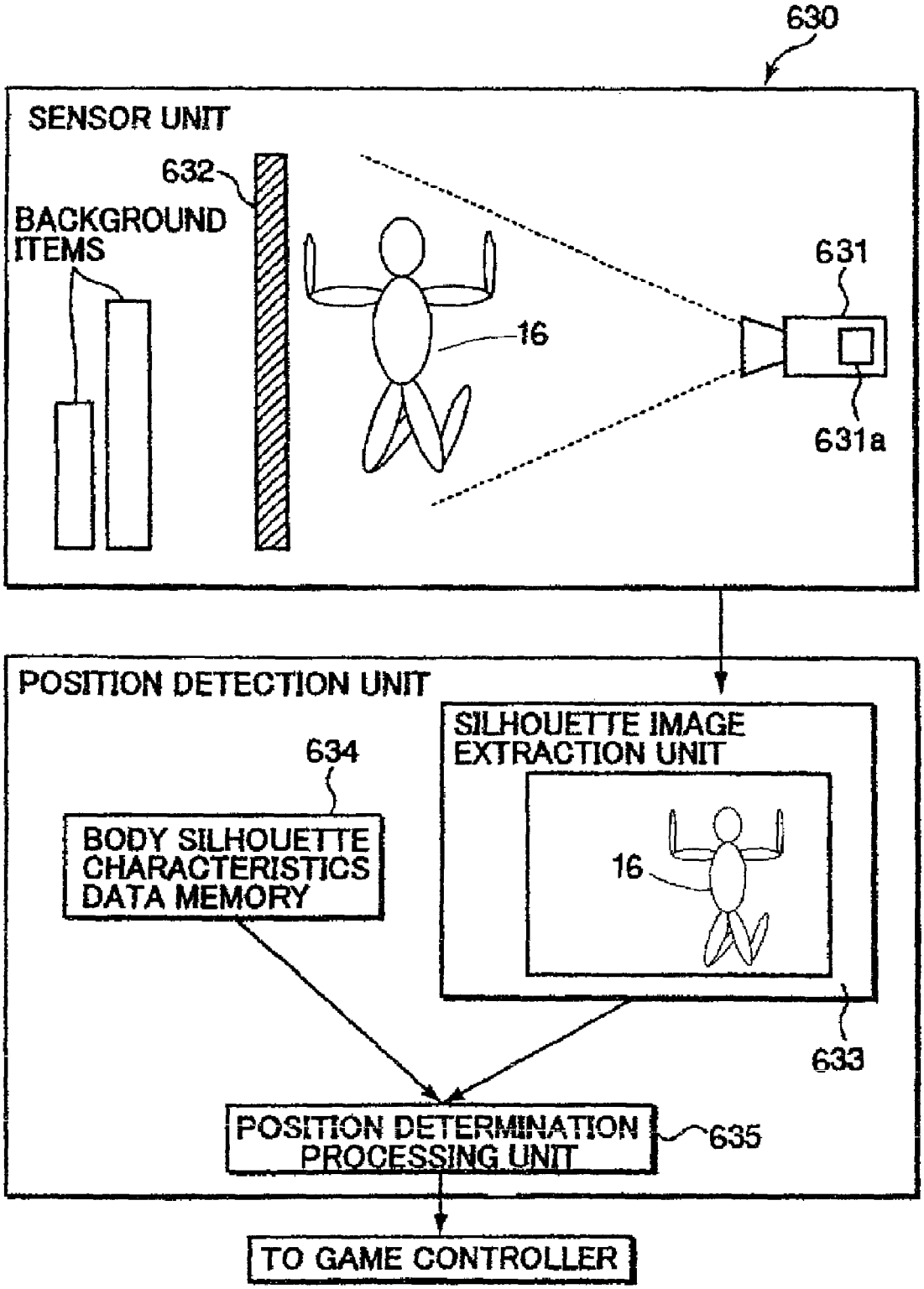
FIG. 23 illustrates a block diagram of the exercise sensing system according to one embodiment of the invention related to FIGS. 9-22.

FIG. 23 is a block diagram showing another embodiment of the head detection unit 530 of the 3D video position sensing device pertaining to the present invention. While this video position sensing device differs somewhat in appearance from the device previously shown, with the exception of the construction of the head detection unit 530, it is functionally identical thereto.

In the second embodiment, the head detection unit 630 comprises (i) a CCD camera 631, for example, which works as an image capture means and is located directly below the monitor 511 and in a horizontally central position, as well as (ii) a background eliminating member 632 that is erected behind the play space and has on its front surface a screen of a single color such as blue or of two colors arranged in a striped pattern. The head detection unit 630 also includes a silhouette image extraction unit 633, a body silhouette characteristics data memory 634 that stores body silhouette characteristics data, and a position determination processing unit 635. The CCD camera 631 is oriented such that the play space is captured in the image.

The CCD camera 631 has an angle of view such that the background eliminating member 632 comprises the field of view, and such that the background items behind the background eliminating member 632 (such as the various equipment (including other game machines) or people seen at the game arcade) are not included in the captured image, and it is preferred that the CCD camera 631 comprise a color image capture means that includes filters for each RGB color that are located on the front surface of the CCD element. The CCD camera 631 faces the background eliminating screen 632 and performs image capture according to prescribed cycles, for example, in cycles of 1/60.sup.th of a second, or at cycles that enable changes in the position of the player's head to be tracked at a desired resolution, and the captured images are stored in an internal image memory 631*a* after undergoing address management. The silhouette image extraction member 633 extracts the silhouette of a body by performing processing to eliminate blue images (in the case of a single-color camera, patternless images) from the image data that includes the player and the background eliminating member 632 located behind the player and that is contained in the image memory 631*a*. This extraction routine may simply comprise processing in which blue regions are deemed regions having no data. Where the background eliminating member 632 has a striped pattern, processing to eliminate this basic pattern may be performed.

The position determination unit 635 (i) uses pattern recognition technology to extract the head from the body silhouette obtained by the silhouette image extraction unit 633 and from the body silhouette characteristics data in the body silhouette characteristics data memory 634, (ii) seeks the position of the eyes in the head, i.e., the center position in the head region, for example, and (iii) performs position determination by deeming this position to be the position of the eyes. The obtained position information is transmitted to the game control unit 600, and is thereafter used as viewpoint information as in the first embodiment.

In addition to the head detection units 530 and 630 used in the first and second embodiments, respectively, the present invention may adopt the following constructions:

(1) A construction may be adopted in which (i) the CCD camera used in the head detection unit 630 of the second embodiment is converted into an infrared camera by the placement of an infrared filter in front of the CCD image capture surface, (ii) an infrared light source that emits infrared light over a range covering the background eliminating member 632 is placed at a position near the infrared camera, and (iii) a substance that absorbs infrared light is applied to the front surface of the background eliminating member 632. Using this construction, because no infrared light is reflected back from the background eliminating member 632 to the infrared camera, the region of the image capturing the background eliminating member 632 becomes dim, and because as a result the difference in brightness between such region and the region reflected from the player can be emphasized, the body silhouette may be easily extracted. Alternatively, a construction may be adopted in which a substance that reflects infrared light is applied to the front surface of the background eliminating member 632. Using this construction, because the light is strongly reflected from the background eliminating member 632 back to the infrared camera, the region of the image capturing the background eliminating member 632 becomes quite bright, and because as a result the difference in brightness between such region and the region reflected by the player can be emphasized, the body silhouette can be easily extracted.

It is also acceptable if a construction is adopted in which the background eliminating member has alternating infrared absorbing regions and infrared reflecting regions arranged in a striped pattern, which would also, like the striped pattern of the second embodiment, permit easy extraction of a body silhouette.

Figure 24:
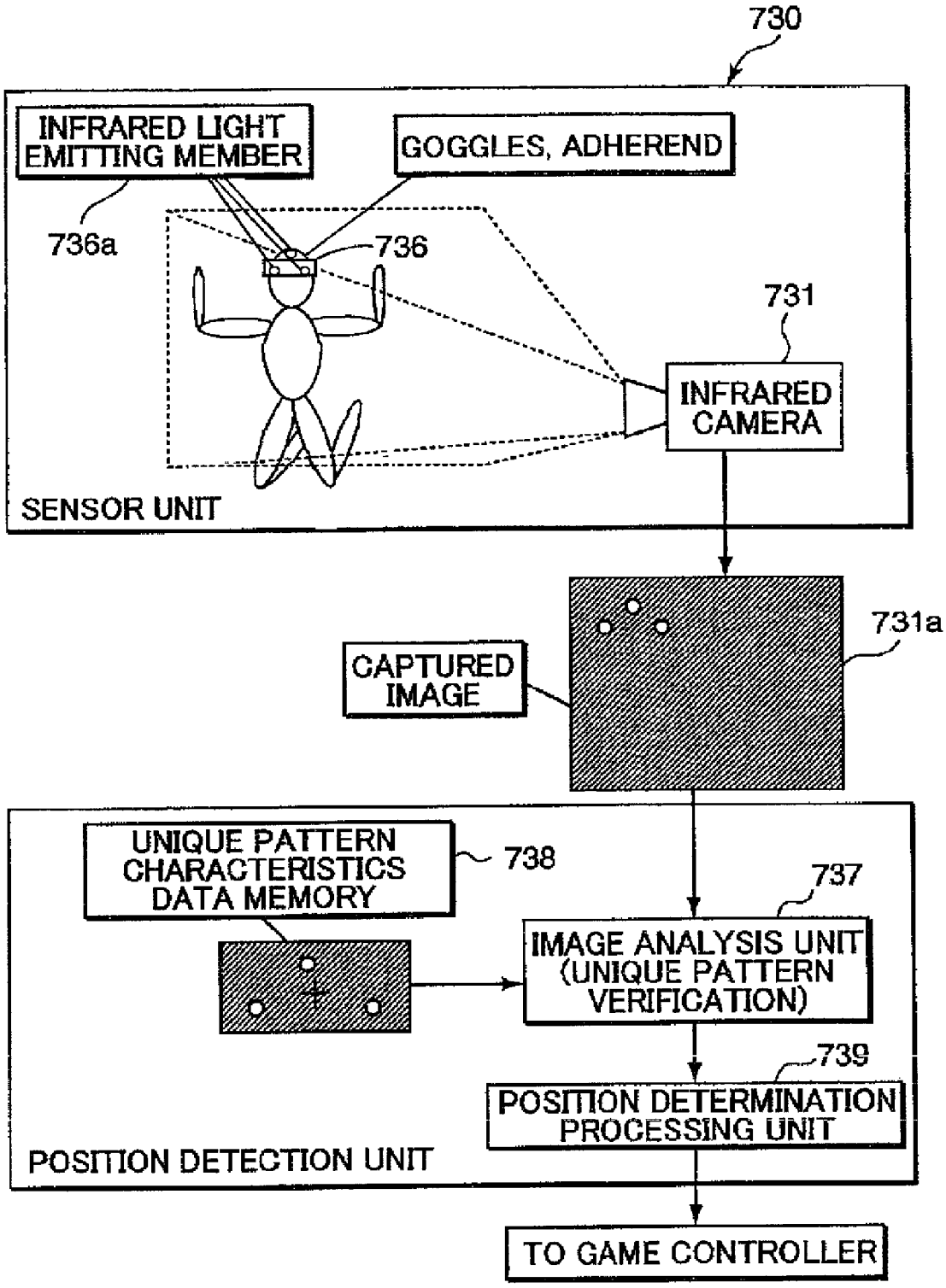
FIG. 24 illustrates a block diagram of the exercise sensing system according to one embodiment of the invention related to FIGS. 9-23.

(2) FIG. 24 is a block diagram showing another embodiment of the head detection unit. The head detection unit 730 comprises the infrared camera 731 explained with reference to the construction (1) above, and includes goggles or a head attachment 736 that may be mounted to the player's face or head, arrayed on which are a prescribed number, such as three, of small infrared photoemitting members 736*a* that emit infrared light, as well as an image memory 731*a*, an image analyzer 737, a unique pattern characteristics data memory 738 and a position determination processing unit 739, which are located inside the processing unit. When the infrared camera 731 captures an image of the player, three brightness points 736*b* are obtained as image data and placed in the image memory 731*a*, the image pattern comprising these three points is compared with the data in the unique pattern characteristics data memory 738 by the image analyzer 737, and the stored positions in the image memory 731*a*, i.e., the addresses, are specified. The position determination processing unit 739 calculates the position of the player's eyes based on a preset equation using the address information for the three points, and this position is sent to the game controller 600. Furthermore, the number of infrared photoemitting members 736*a* is set at three, but as a practical matter detection may be carried out with at least one member. However, because the use of two or more allows the angle of the head or face to be detected at the same time, such a construction offers the advantage of enabling the more accurate determination of the position of the player's eyes.

Furthermore, it is also acceptable if, (i) instead of the infrared photoemitting members 736*a*, a prescribed number of reflective mirrors that reflect infrared light are located on the head attachment 736, and (ii) an infrared photoemitting means having a wide irradiation range is mounted to the video position sensing machine main unit 510, enabling the infrared camera 731 to capture light reflected from the reflective mirrors, which provides the same effect as that described above. In this case, the absence of a need for a power supply, drive means and the like on the head attachment 736 to emit infrared light enables the head attachment 736 to be made smaller and lighter.

Figure 25A:
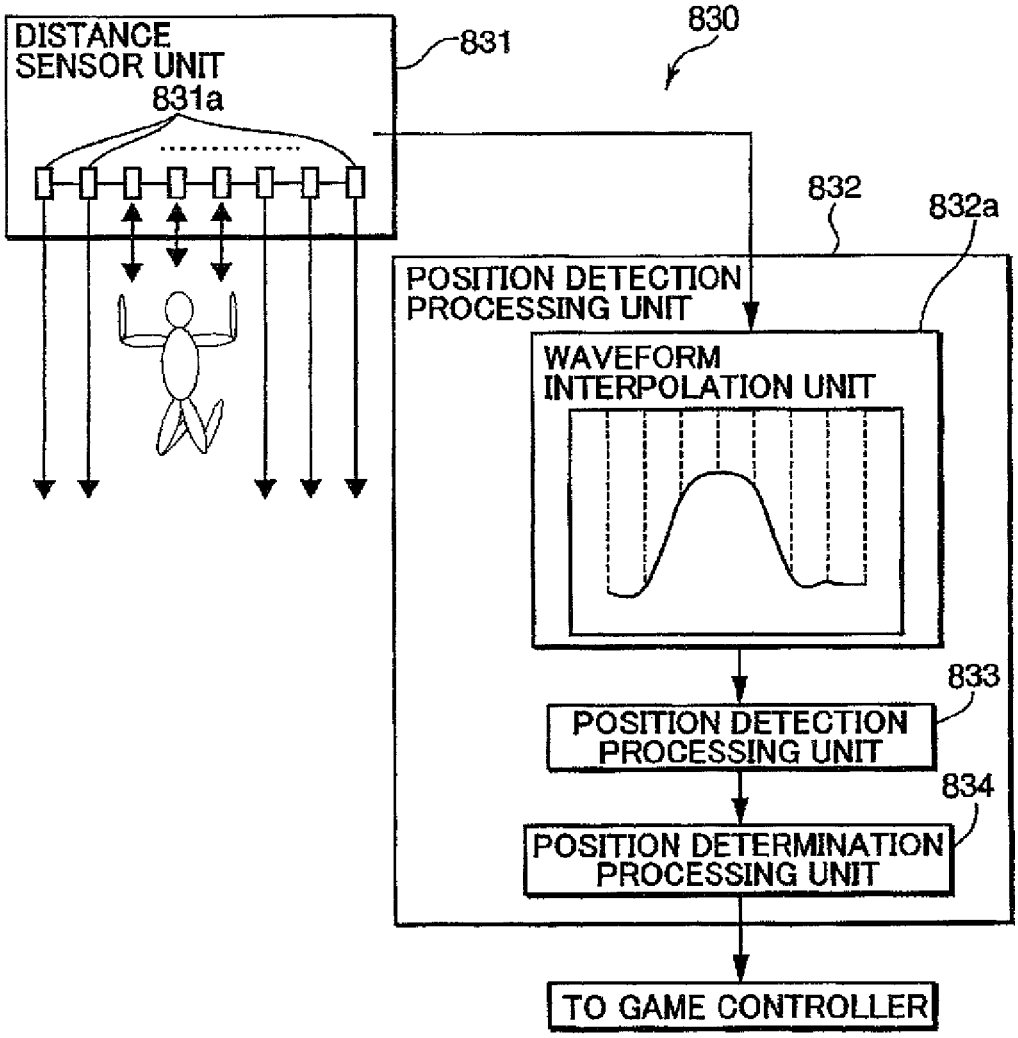
FIGS. 25A and B illustrates a block diagram and a graph of the exercise sensing system according to one embodiment of the invention related to FIGS. 9-24.
Figure 25B:
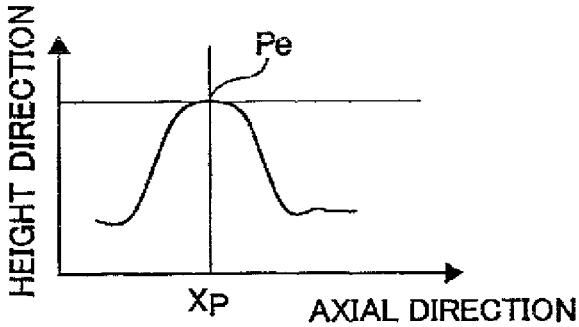

(3) FIG. 25 shows yet another embodiment of the head detection unit. In the drawing, FIG. 25A is a block diagram and FIG. 25B is a drawing to explain position detection.

The head detection unit 830 includes a distance sensor unit 831 comprising multiple ultrasonic transmitter/receivers 831*a* aligned horizontally at a prescribed pitch at the top of the play space, as well as a position detection processing unit 832, a peak point detection unit 833 and a position determination processing unit 834, which are located in the processing unit. As is known in the art, the ultrasonic transmitter/receivers 831*a* each include at least a piezoelectric element, an excitation member that excites the piezoelectric element via pulse signals and causes it to transmit ultrasonic pulses, a receiver unit that receives the reflected pulses, a circuit to switch the signal I/O direction, etc. The distance sensor unit 831 may comprise a reflection-type (preferably infrared light-based) sensor having a photoemitter part and a photoreceptor part. Each ultrasonic transmitter/receiver 831*a* of the distance sensor unit 831 has a directional width that extends directly downward such that at least one (preferably more than one) can detect the position of the player's head in the play space. Alternatively, the ultrasonic transmitter/receivers 831*a* are mounted at intervals narrower than the width of a normal head.

The ultrasonic transmitter/receivers 831*a* can simultaneously transmit ultrasonic waves, but it is acceptable if, in order to prevent adjacent transmitter/receivers from interfering with each other, they transmit ultrasonic waves sequentially in a rapid procession, or if at least alternating ultrasonic transmitter/receivers 831*a* are caused to transmit ultrasonic waves at the same time such that adjacent transmitter/receivers alternate in their transmission. However, because when narrow-directivity ultrasonic beams are used, the data received by the transmitting ultrasonic transmitter/receiver 831*a* is deemed the shortest distance data, there is no particular obstacle in identifying the ultrasonic transmitter/receiver 831*a* that obtains the smallest distance data even where a nearby ultrasonic transmitter/receiver 831*a* also receives the reflected waves.

As shown in FIG. 25, the returning waves reflected from the player's head are received by the transmitting ultrasonic transmitter/receivers 831*a*, and by seeking the distance calculated from the interval between the transmission time and the receipt time of these waves via the position detection processing unit 832 using sound velocity information, data (shown as an image in graph 832*a*) showing the relationship between the pitch width of the ultrasonic transmitter/receivers 831*a* and the distance is obtained. The peak point detection unit 833 uses the above pitch width and distance data to detect the height position Pe and the right/left position Xp of the peak point, as shown in FIG. 25B. Because the height direction waveform is mountain-shaped, as shown in FIG. 25B, by using a model function or the like set beforehand in the position detection unit 832 to give it a function to create continuous data, the peak point detection unit 833 can perform detection even where the peak point is located between ultrasonic transmitter/receivers 831*a*. The position determination processing unit 834 can determine the height position of the player's eyes by subtracting a prescribed value from the height position Pe, which is the player's detected head top, and the right/left position can be determined from the mounting pitch of the ultrasonic transmitter/receivers 831*a*. Information regarding the height position and right/left position of the player's eyes obtained in this fashion is transmitted to the game controller 600.

(4) In the first embodiment, the ultrasonic receivers 532 and 533 were placed along a straight line to the right and left of the ultrasonic transmitter 531, and the height position and right/left position of the player's head was detected based on this construction, but alternatively, a construction may be adopted in which (i) three ultrasonic receivers are placed at prescribed locations on a horizontal plane that includes the ultrasonic transmitter, (ii) three ellipsoids are determined by each ultrasonic receiver from the time of measurement, i.e., the distance information, and (iii) their intersection points are detected as the head position. This construction offers the advantage that the head position can be detected within a three-dimensional space. This construction requires only a minimum of three ultrasonic receivers.

(5) For these embodiments, the example of a trampoline game/exercise system was used, but the present invention may be applied in the same fashion in other types of games in which the player engages in combat with another character by moving along at least two axes.

Summing up the aforementioned descriptions, the present invention relates to a 3D video position sensing device controller that generates operation signals based on which game action instructions are issued, including a pair of right and left main units configured to allow manual operation and motion detection units that are each mounted in each main unit and individually detect movement along at least two axes, as well as output detected movement as operation signals.

According to the aforementioned aspect of the invention, if each main unit is moved by hand while being held by the player's right and left hands or worn like gloves, movement of the hand is detected in accordance with the direction of the movement of the main unit, and various types of games may be operated based on this detection.

In the 3D video game device controller, each of the motion detection units individually may be set to detect movement along three axes. Using this construction, because movement along three axes can be detected as the directions of hand movement, more complex game action may be performed based on the various operation signals.

In the aforementioned video game device controller, each of the main units is preferably formed in the shape of a hand sensor in which a hand is inserted. With this feature, because the controller may be operated with the player's hands inside the device, it is well suited for use in fighting games such as boxing games.

Furthermore, in the aforementioned 3D video game device controller, the controller may include a signal line to enable connection with the video position sensing machine. Using this construction, because the controller can be connected to the video position sensing machine, the connection can also be used to prevent theft of the controller.

Moreover, in the 3D video game device controller, each of the motion detection units may be set to comprise an acceleration sensor placed so as to operate in each direction. Using this construction, hand movement can be detected relatively easily. With this feature, hand movement can be detected relatively easily.

Another aspect of the present invention relates to a 3D video position sensing device including a monitor that is positioned at a prescribed height relative to the video position sensing machine housing and displays images, the controller that is described in any of the aforementioned forms and that causes the content of the game operation to be reflected in the game action, game control means that controls the progress of the game based on operation signals from the controller, display control means that creates three-dimensional images from the viewpoint of a virtual camera and displays them on the screen of the monitor, head detection means that detects the position of the head of a player positioned within the play space in front of the monitor screen in at least the right and left directions in the space surrounding such head, and viewpoint change means that moves the viewpoint of the virtual camera in accordance with the direction and amount of change in the detected head position.

According to the aforementioned aspect of the present invention, because the position of the head of the player operating at a position facing the monitor is detected and the viewpoint of the virtual camera used in the game is moved based on the results of this detection, a more realistic feel can be provided to the player. Moreover, if the operation signals from the controller are controlled with regard to the connecting or missing of a hand movement, for example, in accordance with the viewpoint of the virtual camera, a more complex and enjoyable game can be provided.

In the 3D video position sensing device, the head detection means preferably detects the height of the head. Using this construction, because both the right/left direction and height direction are detected, the viewpoint of the virtual camera can be changed to the desired position.

In addition, in the aforementioned 3D video position sensing device, the display control means may be set to display an opponent character on the monitor screen as a game image, while the game control means displays the opponent character hand movement and instructs that a movement effect routine be performed such that a hand movement is performed and the player when there is a virtual camera viewpoint aiming in the direction in which the hand movement was made. Using this construction, a hand movement is achieved by the opponent character either randomly or in accordance with prescribed game rules, and if the player is directly facing the monitor when such a hand movement is achieved, an effect routine is performed to indicate that the hand movement was correct, providing a highly realistic game.

Moreover, in the 3D video position sensing device, the game control means is preferably to process the operation signals from the motion detection units as achieved hand movement signals and instructs the execution of a effect routine such that hand movements display on the monitor screen. Using this construction, because effects display is performed in response to the opponent character on the monitor screen receiving a hand movement, realistic action is portrayed.

Although the present invention has been fully described by way of example with reference to the accompanied drawings, it is to be understood that various changes and modifications will be apparent from the scope of the present invention hereinafter defined, they should be construed as being included therein.

Variations of the Illustrated Embodiments

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, although the figure illustrates a circular trampoline mat, one skilled in the art would appreciate that the trampoline mat may vary in size, shape, design, configuration, color, height, length, width, and still perform its intended function.

More, there may be an embodiment wherein a trampoline and/or mat also includes another exercise device and/or wherein an exercise device is utilized instead of the trampoline and/or mat. Exercise devices may include but are not limited to bicycles, treadmills, balance boards, exercise balls, weights, exercise bands, and the like. In each place where the term trampoline and/or mat is used in this application it may be replaced with exercise device or with foot associated exercise device for the purposes of this section. A foot associated exercise device is an exercise device wherein proper utilization of the device involves placement of a foot.

Additionally, although the figures illustrate one of the sensor modules only being disposed with the trampoline mat, one skilled in the art would appreciate additional sensor modules configured to the support members of the trampoline, in addition, additional sensor modules may be configured to couple to a user to monitor the user's health conditions, body part positions and still perform its intended function.

It is envisioned that the components of the device may be constructed of a variety of materials, such as but not limited to rubber, rubber composite, metal, metal alloys, plastic, plastic composite, textiles, etc. and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of, or to consist essentially of, one or more of the functions, features, structures, and/or methods described herein.

What is claimed is:

1. An exercise system, comprising:

a) a computer module, having a memory module, a processing module, video module; and sensor movement module, and designed to send information to the video module that is processed in the processing module that received sensor information from the sensor movement module;

b) a trampoline configured to provide a platform for a user to perform user body motion exercises thereon;

c) a sensor module, electronically coupled to the computer module and coupled to the trampoline, designed to capture user body motion exercises and create sensor information therefrom, send the sensor information, to the computer module, about the sensor information created by the sensor module capturing the user body motion exercises; and d) a monitor module, electronically coupled to the video module, and designed to receive video information from the video module to display video images of the user body motion exercises performed using the trampoline.

2. The exercise system of claim 1, wherein the sensor module includes a trampoline mounted sensor that senses the movement of a user on the trampoline.

3. The exercise system of claim 1, wherein the sensor module includes a user mounted sensor that senses the movement of at least a portion of the user for displaying an avatar simulating movement of at least a matching portion of the user on the video module.

4. The exercise system of claim 3, wherein the portion of the user movement being sensed is selected from the group including a hand, a foot, a leg, a head, an arm, a torso, a knee, a wrist, a neck, a finger, a toe, a face, a waist, an ankle, a shoulder, a stomach, a rear end, a chest, or a calf.

5. The exercise system of claim 2, wherein the sensor module includes a whole user body sensor that senses the movement of the whole body of the user for displaying an avatar simulating the whole body movement of the user on the video module.

* * * * *